US006346088B1

(12) United States Patent
Stone et al.

(10) Patent No.: US 6,346,088 B1
(45) Date of Patent: Feb. 12, 2002

(54) APPARATUS FOR ATTACHING A MASSAGING MACHINE TO A SUPPORT MEMBER

(76) Inventors: Leonard J. Stone, deceased, late of Memphis, TN (US), by Roger J. Stone, Gerald C. Stone, executors; Philip Kantor, 5661 Shady Glen, Memphis, TN (US) 38120

( * ) Notice: Subject to any disclaimer, the term of this patent is extended or adjusted under 35 U.S.C. 154(b) by 0 days.

(21) Appl. No.: 09/593,095

(22) Filed: Jun. 13, 2000

Related U.S. Application Data

(63) Continuation-in-part of application No. 09/049,425, filed on Mar. 27, 1998, now abandoned, which is a continuation-in-part of application No. 08/845,832, filed on Apr. 28, 1997, now abandoned, which is a continuation-in-part of application No. 08/715,102, filed on Sep. 18, 1996, now Pat. No. 5,776,085.

(51) Int. Cl.[7] ..... A61H 23/02
(52) U.S. Cl. ..... 601/99; 601/26
(58) Field of Search ..... 601/48, 57, 59, 601/133, 97–99; 482/130, 142; 297/230.14, 284.14, 284.9; 606/204; 602/59, 56, 57, 58

(56) References Cited

U.S. PATENT DOCUMENTS

| | | | | |
|---|---|---|---|---|
| 2,060,298 | A | 11/1936 | Gailey | 155/182 |
| 2,345,439 | A | 3/1944 | Tompkins | 128/45 |
| 3,279,849 | A | 10/1966 | Radke et al. | 297/284 |
| 3,322,116 | A | 5/1967 | Murphy et al. | 128/33 |
| 3,405,709 | A | 10/1968 | Mathers | 128/33 |
| 3,811,430 | A | 5/1974 | Kawakami | |
| 4,006,739 | A | 2/1977 | Wahl | |
| 4,097,087 | A | 6/1978 | Garavaglia | 297/284 |
| 4,634,176 | A | 1/1987 | Scott | 297/230 |
| 5,188,096 | A | 2/1993 | Yoo | |
| 5,374,238 | A | 12/1994 | Xiao | 601/57 |
| 5,545,177 | A | 8/1996 | Coseo | 606/204 |
| 5,624,158 | A | 4/1997 | Adat et al. | 297/230 |
| 5,848,980 | A | 12/1998 | Demerals | 601/46 |

*Primary Examiner*—Jerome W. Donnelly
(74) *Attorney, Agent, or Firm*—Walker, McKenzie & Walker, P.C.

(57) ABSTRACT

An apparatus for mounting a portable massaging machine to a support member having a seat portion. The apparatus includes anchor structure for being held fixed to the support member by the person using the apparatus; a backboard member attached to the anchor structure; and securing structure for movably securing the portable massaging machine to the backboard member.

7 Claims, 14 Drawing Sheets

APPARATUS FOR ATTACHING A MASSAGING MACHINE TO A SUPPORT MEMBER

CROSS-REFERENCE TO RELATED APPLICATIONS

This application is a continuation-in-part of application Ser. No. 09/049,425, filed Mar. 27, 1998, entitled "Apparatus For Attaching A Massaging Machine To A Support Member," now abandoned, which is a continuation-in-part of application Ser. No. 08/845,832, filed Apr. 28, 1997, entitled "Apparatus For Attaching A Massaging Machine To A Support Member," now abandoned, which was a continuation-in-part of application Ser. No. 08/715,102 filed Sep. 18, 1996, now U.S. Pat. No. 5,776,085, issued Jul. 7, 1998, entitled "Apparatus For Attaching A Massaging Machine To A Support Member."

STATEMENT RE FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Field of the Invention

The present invention relates, in general, to an apparatus for adjustably and removably attaching a massaging machine to a support member such as a chair to enable a user to control the position of the massaging machine so it can be directed to very specific areas of the spine, neck, and other body parts.

2. Information Disclosure Statement

A preliminary patentability search conducted in class 601, subclasses 86, 90, 115, 146, 116, 66, 52 and 57 produced the following patents which appear to be relevant to the present invention:

Tompkins, U.S. Pat. No. 2,345,439, issued Mar. 28, 1944, discloses a therapeutic device adapted to be attached to a standard bed frame in a position over a mattress so that gyratory oscillations may be imparted to a person reposing on the mattress and abutting the device. The device includes a pair of plates for clamping a portion of the bed frame therebetween, and a parallelogram-type linkage extending between the plates and housing having a vibrating face surface or the like for abutting a person's back, etc.

Murphy et al., U.S. Pat. No. 3,322,116, issued May 30, 1967, discloses a vibratory massage apparatus adapted to be installed in a chair or table, etc. The massage apparatus includes a track, a carriage mounted on the track, a plurality of massage rollers, a pair of outwardly bowed spring members connecting the massage rollers to the carriage, and vibration means for vibrating the rollers and springs.

Mathers, U.S. Pat. No. 3,405,709, issued Oct. 15, 1968, discloses a massage assembly adapted for reciprocating travel within a cushioned framework such as a chair backrest or massage table. The massage assembly includes a carriage baseframe, a pair of arched springs arranged in parallel relation and extending longitudinally of the baseframe with the ends thereof secured to the baseframe, and a vibration producing unit mounted to a suspension bar extending between and attached to the arched springs.

Kawakami, U.S. Pat. No. 3,811,430, issued May 21, 1974, discloses a portable massaging device including a motor, a pair of eccentrically rotatable vibrator elements for producing vibrations through a housing structure, and a plurality of coil springs for amplifying the vibration. The motor, vibrator elements and housing structure are covered with sponge material to enable the device to be used as a cushion.

Wahl, U.S. Pat. No. 4,006,739, issued Feb. 8, 1977, discloses a portable cushion including back padding, front padding, a rigid or semi-rigid frame member between the front and back padding, and a vibratory mechanism contained in a casing which is located in the lower portion of the frame member. The position of the casing is such that when the cushion is placed next to the back of a chair with its lower end resting on the seat of the chair, the casing will be approximately even with the lumbar region of an adult sitting in the chair.

Yoo, U.S. Pat. No. 5,188,096, issued Feb. 23, 1993, discloses a massage apparatus including a mat having a plurality of massage cells arranged in each of several lateral and vertical rows and adapted to be vibrated individually, and a control device that allows the massage area, massage intensity and operating time to be changed.

Portable massaging machines such as, for example, "The Masseur"™ model CN-168M portable massager sold by K-Tel International (USA) Inc., are designed to be hand held by the person receiving treatment or another person giving treatment, and generally include a housing having a pair of handles on opposite sides thereof and a face surface with massaging fingers or the like extending therefrom for engaging and massaging (i.e., kneading and/or vibrating) a portion of a person's body.

Nothing in the known prior art discloses or suggests the present invention. More specifically, nothing in the known prior art discloses or suggests an apparatus for mounting a portable massaging machine to a support member having a seat portion, the apparatus including anchor means for being held fixed to the support member by the person using the apparatus; a backboard member attached to the anchor means; and securing means for movably securing the portable massaging machine to the backboard member.

BRIEF SUMMARY OF THE INVENTION

The present invention provides structure for attaching a portable massaging machine to a chair or the like. The present invention relates to an accessory for a portable massaging machine that enables the user to control the position of the portable massaging machine so it can be directed to very specific areas of the user's spine, neck, and other body parts. A basic concept of the present invention is to provide first means for being anchored to a chair or the like, and second means for being attached to the portable massaging machine and for being movably attached to the first means.

The present invention included, in general, an apparatus for mounting a portable massaging machine to a support member having a seat portion, the apparatus including anchor means for being held fixed to the support member by the person using the apparatus; a backboard member attached to the anchor means; and securing means for movably securing the portable massaging machine to the backboard member.

One object of the present invention is to provide an accessory for a typical portable massaging machine that frees the user from holding the massaging machine or from the help of another person.

Another object of the present invention is to provide such an accessory that enables the user to direct the kneading or vibrating action of the massaging machine to individual vertebrae of the spine from the lumbar or lower level to the neck.

Another object of the present invention is to provide such an accessory that enables the user to control the intensity of the treatment by varying his or her own body pressure to produce the most efficient and comfortable effect.

DETAILED DESCRIPTION OF THE INVENTION

Figure 1:
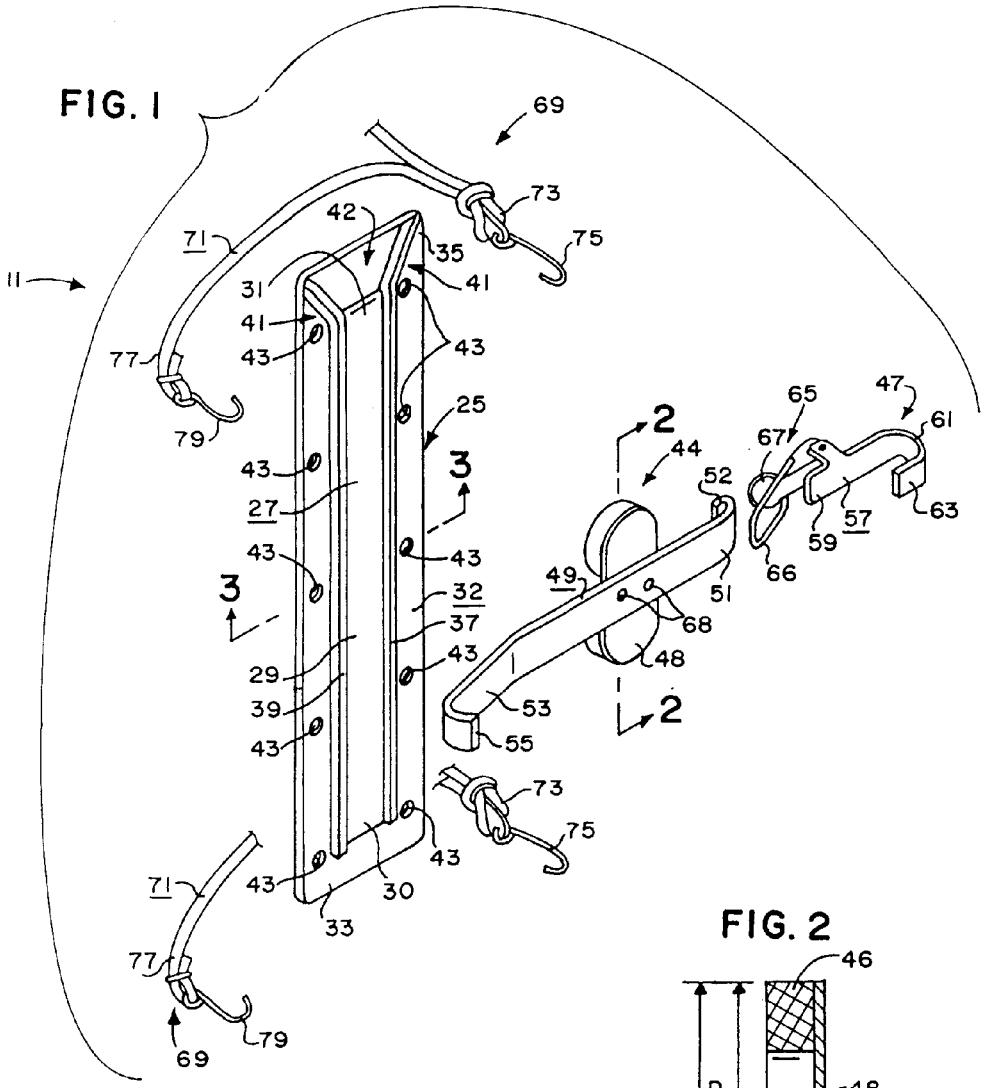
FIG. 1 is an exploded perspective view of one preferred embodiment of the apparatus of the present invention.

One preferred embodiment of the apparatus of the present invention is shown in FIGS. 1–9, and identified by the numeral 11. The apparatus 11 is specifically designed for mounting a portable massaging machine M to a support member, such as a standard straight-back chair C (see FIG. 4), a typical secretarial-type chair S (see FIG. 6), or the like.

The massaging machine M may consist of any typical, off-the-shelf portable massaging machine such as, for example, "The Masseur"™ model CN-168M portable massager sold by K-Tel International (USA) Inc., of 15535 Medina Rd., Plymouth, Minn. 55447, designed to be hand held by the person receiving treatment or another person giving treatment, and generally including a housing 13 having a handle 15 on each side thereof, a back surface 16, and a face surface 17 with massaging fingers 19 or the like extending therefrom (see FIG. 5) for engaging and massaging (e.g., kneading and/or vibrating) a portion of a person's body.

Figure 4:
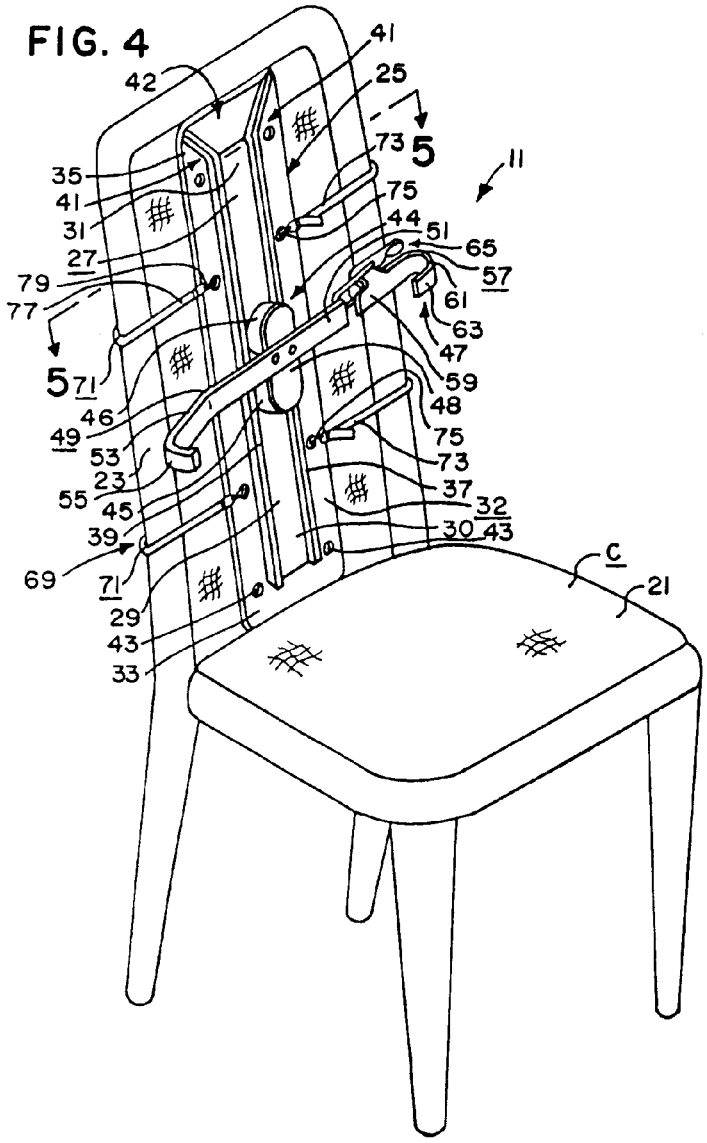
FIG. 4 is a perspective view of the apparatus of FIG. 1, combined with a chair having a standard backrest portion.

While the support member may consist of any structure used to support at least a portion of a person's body such as a straight chair, an armchair, a recliner, a rocking chair, a folding chair, a stool, a sofa, a bed, an exercise machine, etc., it preferably consists of a standard chair C having a seat or seat portion 21 and preferably having a back or back portion 23 (see FIG. 4).

The apparatus 11 preferably includes a body or backboard member 25 for attachment relative to the support member, e.g., to the back portion 23 of the chair C. The body member 25 has a magnetic member or portion 27 (i.e., a member or portion that is capable of being magnetized or attracted by a magnet). The magnetic portion 27 has a face surface 29, a first or lower end 30 and a second or upper end 31. The second or upper end 31 is preferably bevelled as clearly shown in FIG. 9.

The body member 25 preferably includes an elongated, rigid base portion or member 32 having a first or lower end 33 and a second or upper end 35. The base member 32 preferably has a first track or ridge member 37 extending generally between the first and second ends 33, 35 thereof; and a second track or ridge member 39 extending generally between the first and second ends 33, 35 thereof and spaced from the first track member 37 a sufficient distance to allow the magnetic portion 27 to be positioned between the first and second track members 37, 39. The first and second track members 37, 39 are preferably parallel to one another from the first end 33 of the base member 32 to an intermediate point 41 a relatively short distance below the second end 35 of the base member 32, and preferably diverge from one another from that intermediate point 41 of the base member 32 to the second end 35 of the base member 32 to form an enlarged mouth 42, as clearly shown in FIGS. 1, 4, 6 and 8. The base member 32 preferably has a plurality of spaced apart apertures 43 therethrough adjacent each side thereof for reasons which will hereinafter become apparent.

The base member 32 may be constructed in various manners, out of various materials, in various shapes and sizes, etc. Thus, for example, the base member 32 is preferably molded, cast, or otherwise constructed as a one-piece, integral unit out of a strong, rigid plastic, etc., as will now be apparent to those skilled in the art.

The magnetic portion 27 of the body member 25 preferably consists of a metal backboard constructed from a flat piece of iron, steel or other metal to which magnets are attracted. The magnetic portion 27 is preferably cemented or otherwise fixedly and securely attached to the base member 32 between the first and second track members 37, 39. The magnetic portion 27 is preferably sized to extend from the first end 33 of the base member 32 to the intermediate point 41 of the base member 32, and between the first and second track members 37, 39.

Figure 2:
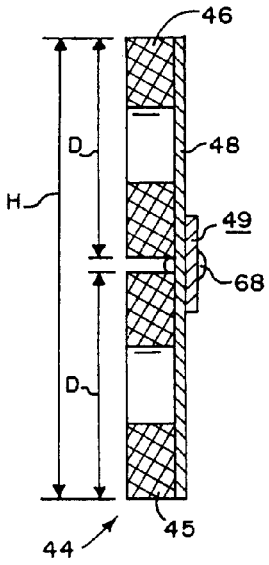
FIG. 2 is a sectional view substantially as taken on line 2—2 of FIG. 1 on an enlarged scale and with portions thereof omitted for clarity.
Figure 3:
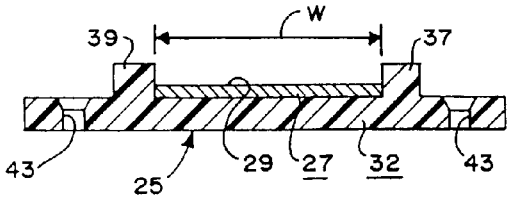
FIG. 3 is a sectional view substantially as taken on line 3—3 of FIG. 1 on an enlarged scale and with portions thereof omitted for clarity.

The apparatus 11 includes securing means for adjustably securing the portable massaging machine M relative to the support member. The securing means of the apparatus 11 preferably adjustably secures the portable massaging machine M to the body or backboard member 25. While the securing means may be of various different physical designs such as, for example, the combination of a plurality of spaced hangers attached the body or backboard member 25, and a hook attached to the portable massaging machine M for engaging the hangers, or an elongated rod attached to the body or backboard member 25, and a follower attached to the portable massaging machine M for engaging the rod, etc., the securing means preferably includes a magnet or magnetic means 44 for movable attachment to the magnetic portion 27 of the body member 25. The magnetic means 44 preferably consists of one or more off-the-shelf permanent magnets, and preferably has a width that allows the magnetic means 44 to slidably fit between the first and second track members 37, 39, and an overall height that is greater than the distance between the first and second track members 37, 39 so that the magnetic means 44 can slide lengthwise of the magnetic portion 27 but cannot fully rotate about an axis perpendicular to the face of the magnetic portion 27. Thus, as shown in FIGS. 1 and 2, the magnetic means 44 may include a ring or disk-shaped first magnet 45 and a ring or disk-shaped second magnet 46 with the diameter D of each magnet 45, 46 (see FIG. 2) slightly less than the width W between the first and second track members 37, 39 (see FIG. 3) so that the first and second magnets 45, 46 can freely slide along the magnetic portion 27 between the first and second track members 37, 39 as will now be apparent to those skilled in the art. However, the first and second magnets 45, 46 are preferably fixed relative to one another in a manner as will hereinafter be fully disclosed so that the combined height H thereof (see FIG. 2) is greater than the width W between first and second track members 37, 39 so that the magnetic means 44, as a unit, is prevented from fully rotating or twisting about an axis perpendicular to the face of the magnetic portion 27 as will now be apparent to those skilled in the art. It should be noted that the magnetic means 44 could consist of an electric magnet of any well known construction. In such a case, the current for the electric magnet could be supplied by the portable massaging machine M, etc., in any manner now apparent to those skilled in the art. The strength of the magnetic means 44 can vary, depending on the weight of the portable massaging machine M to be attached to the chair C, etc., as will now be apparent to those skilled in the art.

Figure 5:
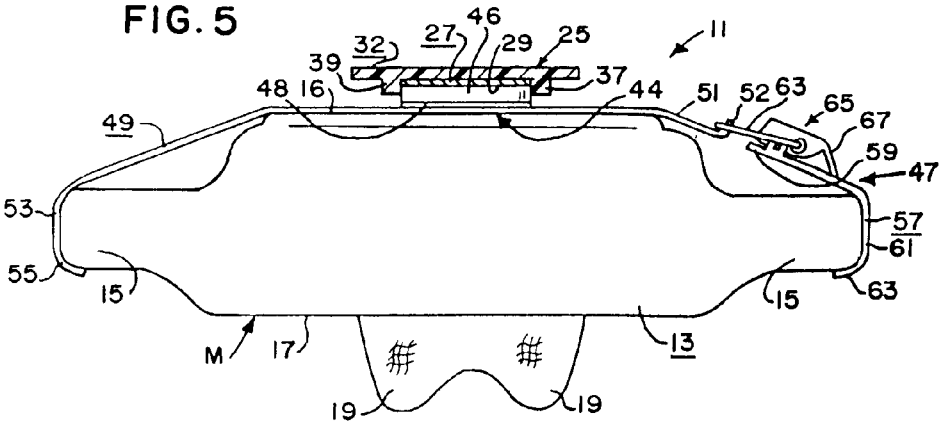
FIG. 5 is a sectional view substantially as taken on line 5—5 of FIG. 4 on an enlarged scale, with portions omitted for clarity, and shown combined with a portable massaging machine.

The apparatus 11 includes mounting means for mounting the securing means to the portable massaging machine M. While the mounting means may be of various different physical designs, one preferred embodiment thereof is shown in FIGS. 1, 4 and 5, and identified by the numeral 47. The mounting means 47 preferably includes a harness for being buckled or otherwise fastened to the portable massaging machine M and to which the magnetic means 44 can be cemented or otherwise fixed. More specifically, the mounting means 47 preferably includes a plate 48 attached to the magnetic means 44 (e.g., the back of each magnet 45, 46 may be cemented or otherwise fixedly attached to the plate 48); a first strap 49 having a first end 51 with a hook 52 and having a second end 53 with a hook 55; a second strap 57 having a first end 59 and having a second end 61 with a hook 63; and a buckle mechanism 65 mounted relative to the first end 59 of the second strap 57 for attaching the second strap 57 to the first strap 49. The hook 55 on the second end 53 of the first strap 49 is adapted to hook onto a portion of the portable massaging machine M (e.g., for hooking onto one of the handles 15). The hook 63 on the second end 61 of the second strap 57 is adapted to hook onto a portion of the portable massaging machine M (e.g., for hooking onto another one of the handles 15). The buckle mechanism 65 preferably includes a ring 66 for hooking onto the hook 52 on the first end 51 of the first strap 49, and a lever-type handle 67 for pivotally joining the ring 66 to the first end 59 of the second strap 57 so that the effective distance between the second end 53 of the first strap 49 and the second end 61 of the second strap 57 can be adjusted to thereby allow the mounting means 47 to be securely attached to the portable massaging machine M. The plate 48, first strap 49 and second strap 57 may be cut and bent out of sheet metal or the like, or otherwise constructed, as will now be apparent to those skilled in the art. The plate 48 is preferably securely attached to the first strap 49 in any manner now apparent to those skilled in the art such as with one or more rivets 68 or the like.

The apparatus 11 preferably includes attachment means 69 for attaching the body member 25 to a support member such as the chair C. The attachment means 69 may include one or more elastic cords 71 for extending from the body member 25, around a portion of the back portion 23 of the chair C, and back to the body member 25 to thereby securely attach the body member 25 to the back portion 23 of the chair C. More specifically, each elastic cord 71 preferably has a first end 73 with a hook 75 thereon for hooking into one of the apertures 43 through one side of the base member 32, and a second end 77 with a hook 79 thereon for hooking into one of the apertures 43 through the other side of the base member 32 as clearly shown in FIG. 4. Each elastic cord 71 may be adjustable in length for accommodating back portions 23 of different dimensions, etc. For example, the hook 75 of the first end 73 of each elastic cord 71 may be slidably attached to the body of the elastic cord 71 to allow the effective length of the elastic cord 71 to be varied as will now be apparent to those skilled in the art. The elastic cords 71 may be constructed in various manners, out of various materials, in various ornamental designs, and in various sizes. Each elastic cord 71 is preferably a typical off-the-shelf product as will now be apparent to those skilled in the art.

Figure 6:
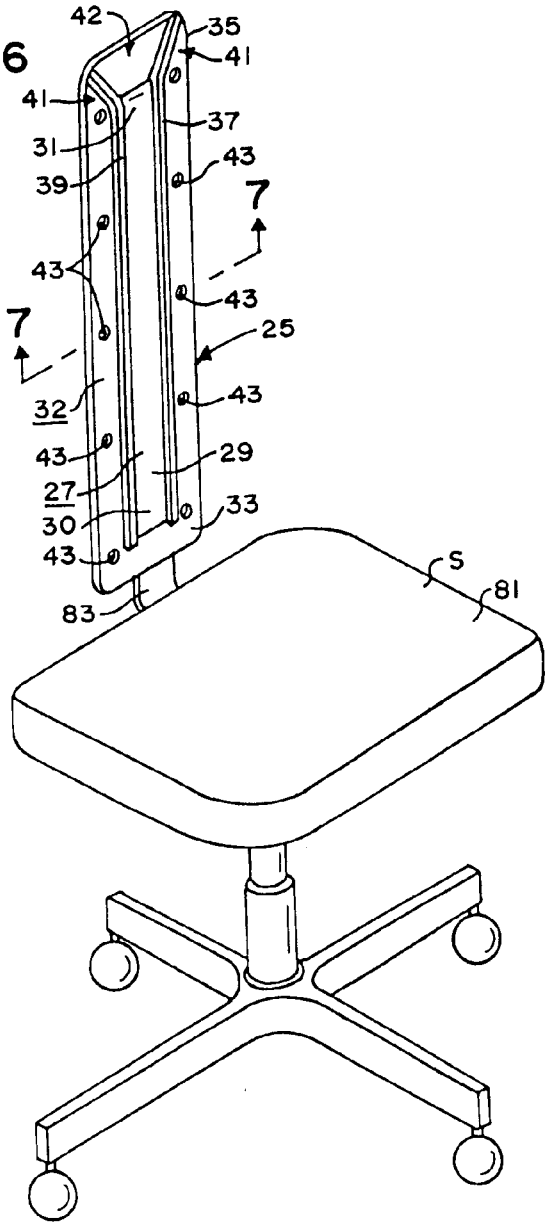
FIG. 6 is a perspective view of a part of the apparatus of FIG. 1, combined with a chair not having a standard backrest portion.
Figure 7:
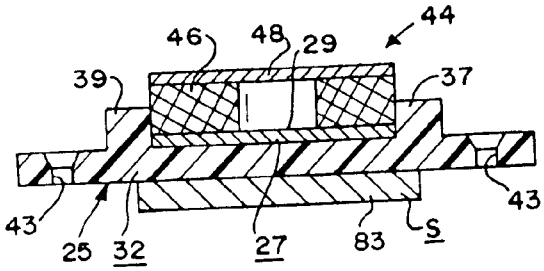
FIG. 7 is a sectional view substantially as taken on line 7—7 of FIG. 6 on an enlarged scale, shown combined with additional parts of the present invention.
Figure 8:
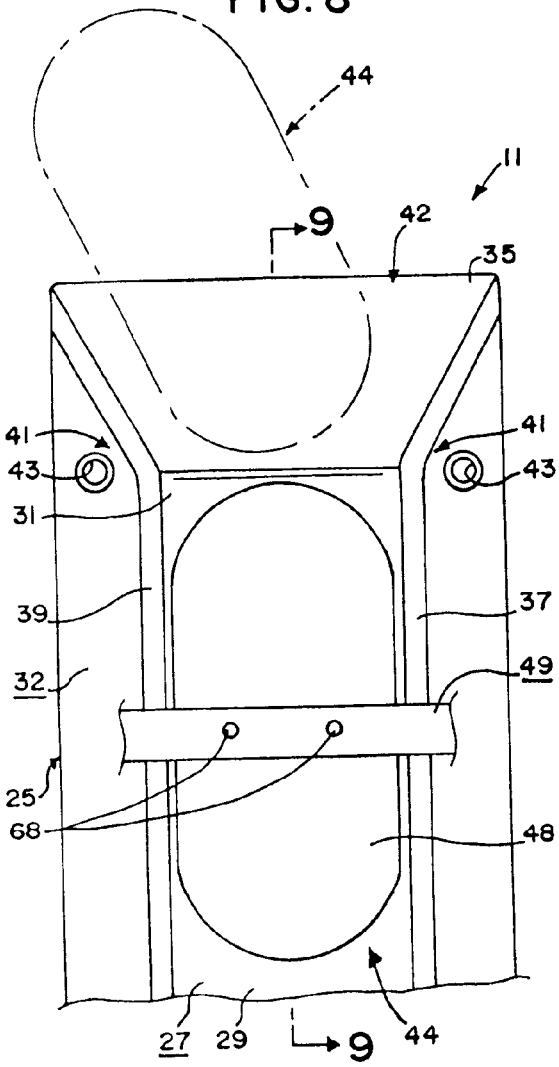
FIG. 8 is a somewhat diagrammatic elevational view of portions of the apparatus of FIG. 1, with portions thereof combined together and with a part thereof shown in a moved position in broken lines.
Figure 9:
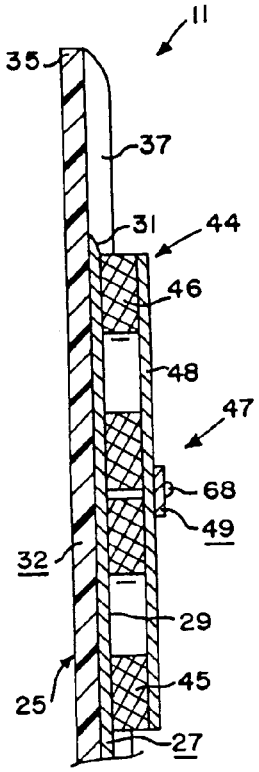
FIG. 9 is a sectional view substantially as taken on line 9—9 of FIG. 8.

On the other hand, the attachment means may consist of glue, screws, bolts, etc., for securely attaching the body member 25 to a support member. More specifically, as shown in FIGS. 6 and 7, the support member may consist of a typical secretarial-type chair S having a seat portion 81 with a relatively rigid spine or elongated bar 83 extending upward from the back of the seat portion 81 to which a relatively small backrest portion is typically slidably mounted. However, the backrest portion can be removed and the body member 25 may be attached to the bar 83 by merely gluing or screwing the base member 32 thereto in a substantially upright position as shown in FIGS. 6 and 7 and as will now be apparent to those skilled in the art. Alternatively, it should be noted that the bar 83 may be a replacement item for replacing the entire back portion of a typical secretarial-type chair and provided as part of the present invention.

The operation and use of the apparatus 11 of the present invention is quite simple. The first step may be to attach the body member 25 to the desired support member. For example, to attach the body member 25 to the chair C, one or more elastic cords 71 are typically used to extend from one edge or side of the base member 32, around the rear of the back portion 23 of the chair C, and to the other edge or side of the base member 32 to securely attach the body member 25 to the chair C, normally in a substantially upright or vertical position. The next step may be to attach the magnetic means 44 to the portable massaging machine M. For example, the mounting means 47 may be buckled to the handles 15 of the housing 13 of the portable massaging machine M to position the first and second magnets 45, 46 on the back surface 16 of the housing 13 of the portable massaging machine M as clearly shown in FIG. 5 and as will now be apparent to those skilled in the art. Next, the combined portable massaging machine M and magnetic means 44 is attached to the body member 25 by merely bringing the first and second magnets 45, 46 into contact with the face surface 29 of the magnetic portion 27 of the body member 25 as shown in FIGS. 4, 5, and 7–9. The mouth 42 formed by the diverging tracks 37, 39 at the second or upper end 35 of the base member 32, combined with the bevel on the second or upper end 31 of the magnetic portion 27 and the omission of the magnetic portion 27 at the second or upper end 35 of the base member 32 allows the magnetic means 44 to be easily brought into contact and aligned with, and subsequently removed from, the magnetic portion 27 as will now be apparent to those skilled in the art. The combined portable massaging machine M and magnetic means 44 can then be easily moved up and down on the magnetic portion 27 to position the massaging fingers 19 of the portable massaging machine M at any desired location, depending on the height of the user, the specific area of the user's back it is desired to massage, etc.

If treatment is desired for problems in the thigh and leg areas, the massaging action can be applied to the lower lumbar vertebrae housing the nerves which supply these areas. Similarly, by raising the position of the machine to a higher level, it will massage vertebrae which house nerves supplying abdominal, thoracic or neck areas.

Figure 10:
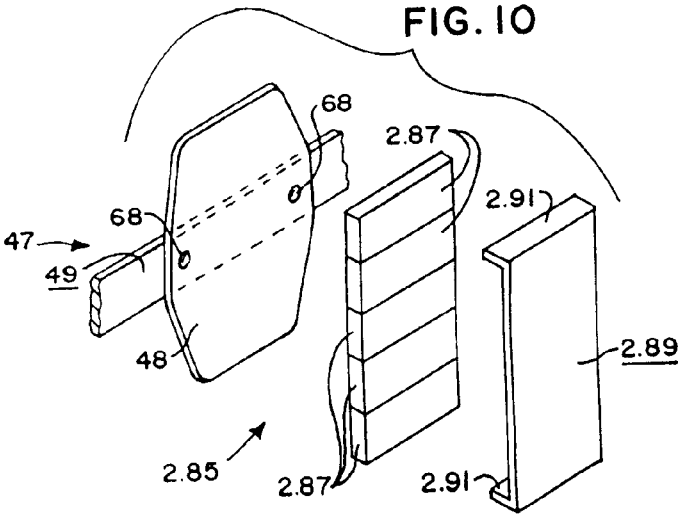
FIG. 10 is an exploded perspective view of an alternate embodiment of the magnetic means of the apparatus of FIG. 1.
Figure 11:
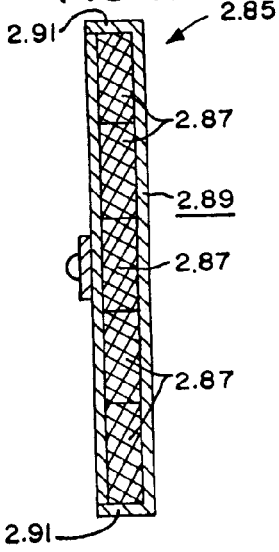
FIG. 11 is a sectional view of the alternate embodiment of the magnetic means of FIG. 10.
Figure 12:
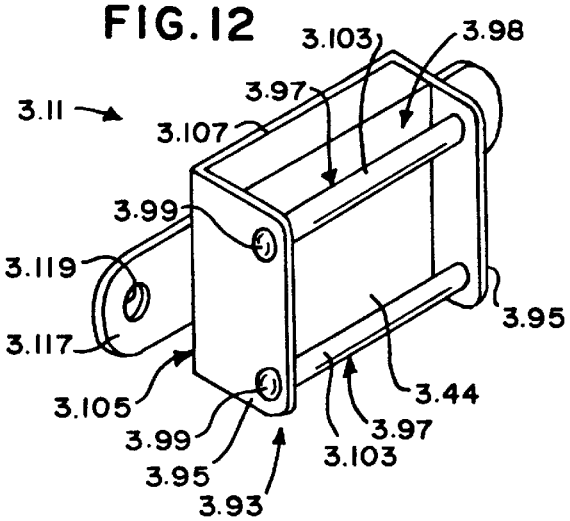
FIG. 12 is a perspective view of another preferred embodiment of the apparatus of the present invention.
Figure 13:
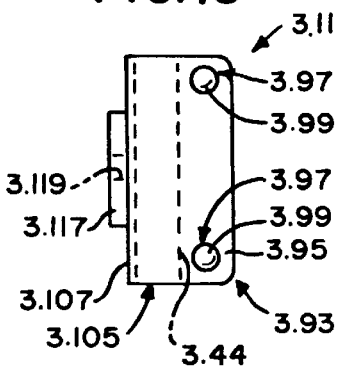
FIG. 13 is a side elevational view of the apparatus of FIG. 12.
Figure 14:
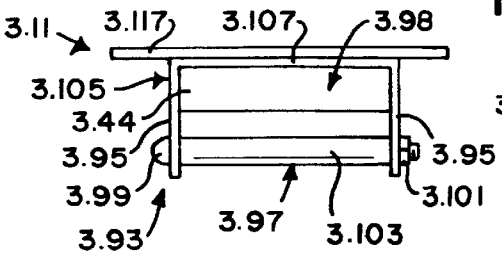
FIG. 14 is a top plan view of the apparatus of FIG. 12.
Figure 15:
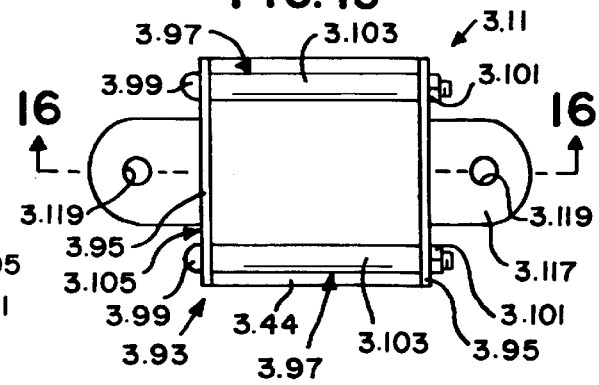
FIG. 15 is a front elevational view of the apparatus of FIG. 12.

An alternate embodiment of the magnetic means is shown in FIGS. 10 and 11, and identified by the numeral 2.85. The magnetic means 2.85 preferably includes a plurality of off-the-shelf bar-type ceramic magnets 2.87 and one or more plates 2.89 for covering all or portions of the face of each magnet 2.87 (i.e., the side of each magnet 2.87 for being positioned against and attracted to the magnetic portion 27) so that the plate 2.89 will protect and reduce wear, noise, etc., between the face of each magnet 2.87 and the magnetic portion 27 as will now be apparent to those skilled in the art. Each end of the plate 2.89 may have a flange 2.91 for extending over a portion of each end of the combined group of magnets 2.87 as clearly shown in FIG. 11 to more securely hold the magnets 2.87 together and to the plate 2.89. The plate 2.89 may be constructed from a single sheet of sheet metal or the like or may consist of one or more pieces of a suitable plastic such as nylon, etc. Appropriate cement or the like (not shown) is preferably provided between each flange 2.91 and the adjacent portion of the plurality of magnets 2.87 to fixedly secure the magnets 2.87 and the plate 2.89 together. The mounting means 47 can also be used for mounting the magnetic means 2.85 to the portable massaging machine M. More specifically, the back of each magnet 2.87 can be attached to the plate 48 of the mounting means 47 for the same reasons and in the same manner as hereinabove disclosed relative to the magnets 45, 46 (e.g., the back of each magnet 2.87 may be cemented or otherwise fixedly attached to the plate 48). It should be noted that the shape of the plate 48 can be modified to conform more closely to the combined shape of the magnets 2.87 as clearly shown in FIG. 10.

Another preferred embodiment of the apparatus of the present invention is shown in FIGS. 12–20, and identified by the numeral 3.11. The apparatus 3.11 is specifically designed for mounting a portable massaging machine M to a support member, such as a typical secretarial-type chair S, or the like, having a seat portion 81 with a relatively rigid spine or elongated bar 83 extending upward from the back of the seat portion 81 (see FIG. 17) to which a backrest portion is typically slidably mounted. However, when used with the apparatus 3.11, the backrest portion is removed from the bar 83. The bar 83 has a magnetic portion 3.27 (i.e., a portion that is capable of being magnetized or attracted by a magnet), and is preferably made entirely from a magnetic material (i.e., a steel bar or the like). In addition, depending on the original height or length of the bar 83, a magnetic extension might be welded or otherwise attached to the upper end of the bar 83 to extend the effective height thereof.

The apparatus 3.11 includes securing means for adjustably securing the portable massaging machine M relative to the support member. The securing means of the apparatus 3.11 preferably adjustably secures the portable massaging machine M to the bar 83 of the chair S. While the securing means may be of various different physical designs such as described hereinabove relative to the securing means of the apparatus 11, the securing means of the apparatus 3.11 preferably includes a magnet or magnetic means 3.44 for movable attachment to the magnetic portion 3.27 of the bar 83 of the chair S. The magnetic means 3.44 preferably consist of one or more off-the-shelf permanent magnets. It should be noted that the magnetic means 3.44 could consist of an electric magnet of any well known construction. In such a case, the current for the electric magnet could be supplied by the portable massaging machine M, etc., in any manner now apparent to those skilled in the art. The strength of the magnetic means 3.44 can vary, depending on the weight of the portable massaging machine M to be attached to the chair C, etc., as will now be apparent to those skilled in the art. Also, while the magnetic means 3.44 is illustrated in the drawings as being generally square or rectangular in shape, it could be generally circular or ring-shaped.

The apparatus 3.11 preferably includes guide means 3.93 for guiding the securing means relative to the support means. More specifically, the guide means 3.93 preferably guides the magnetic means 3.44 relative to the magnetic portion 3.27 of the bar 83. The guide means 3.93 preferably includes ear members 3.95 extending upward from two opposite sides of the magnetic means 3.44, and at least one and preferably two neck or gate members 3.97 extending between each ear member 3.95 a spaced distance from the face of the magnetic means 3.44 (see, in general, FIG. 16). A void 3.98 is thus created between the face of the magnetic means 3.44, the inner side of each ear member 3.95, and the inner side of each gate member 3.97 for guidingly and slidably receiving the bar 83 (see, in general FIG. 19). While a single gate member 3.97 will coact with the ear members 3.95 to form the void 3.98, two spaced gate members 3.97 will prevent any pivoting or rocking movement between the bar 83 and the guide means 3.93 as will now be apparent to those skilled in the art.

Figure 16:
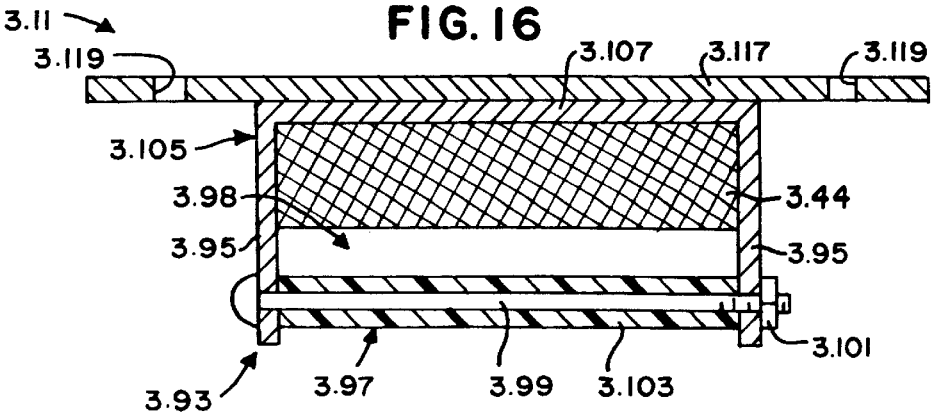
FIG. 16 is a sectional view substantially as taken on line 16—16 of FIG. 15, on an enlarged scale.
Figure 17:
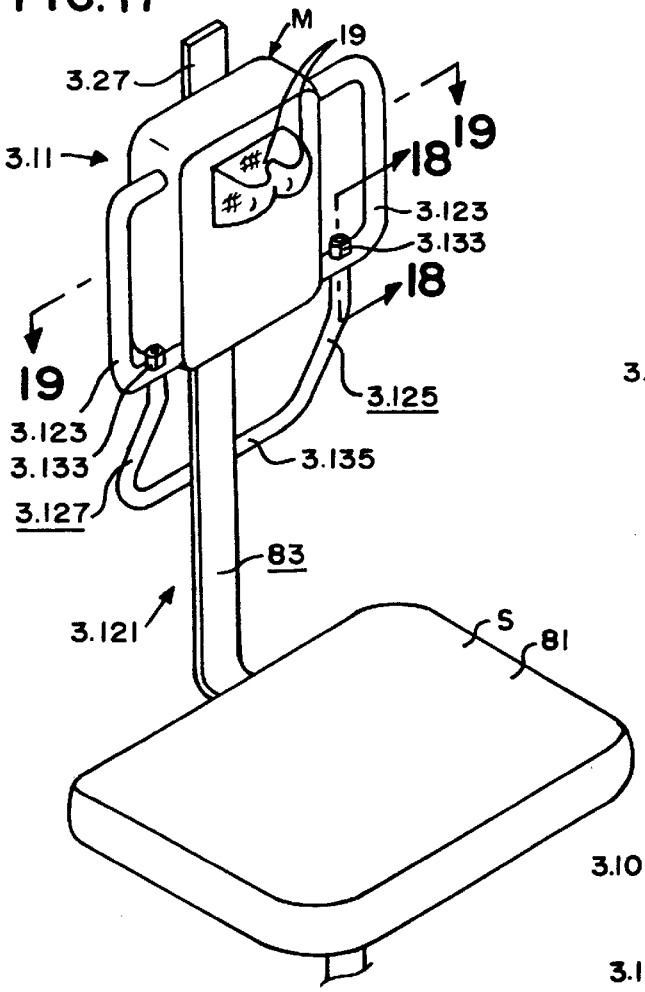
FIG. 17 is a perspective view of the apparatus of FIG. 12, shown combined with a portable massaging machine and a chair not having a standard backrest portion.
Figure 18:
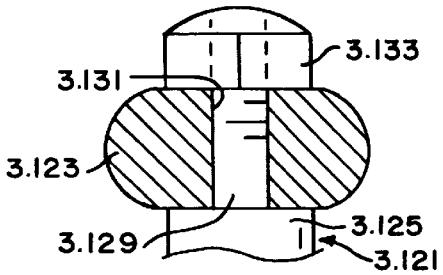
FIG. 18 is a sectional view substantially as taken on line 18—18 of FIG. 17, on an enlarged scale.
Figure 19:
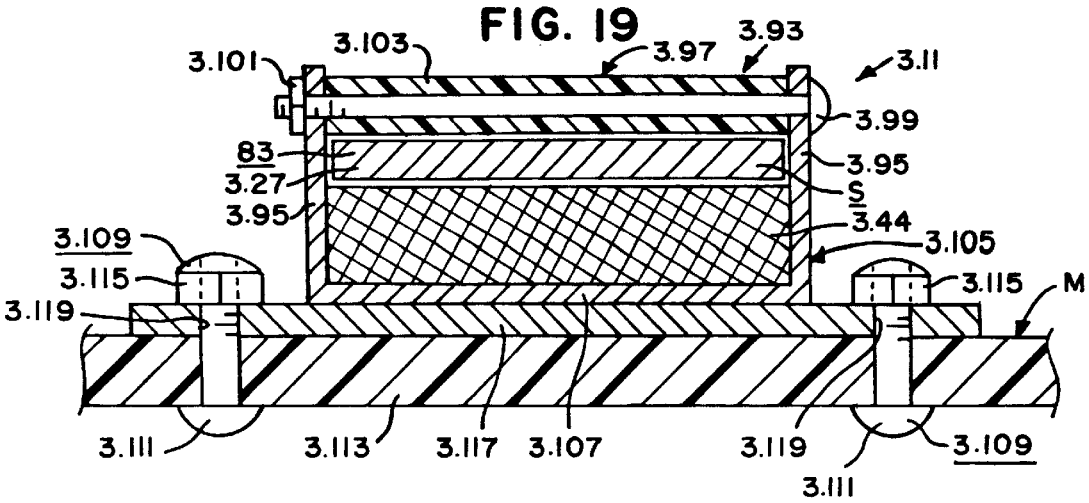
FIG. 19 is a sectional view substantially as taken on line 19—19 of FIG. 17, on an enlarged scale and with portions thereof broken away for clarity.
Figure 21:
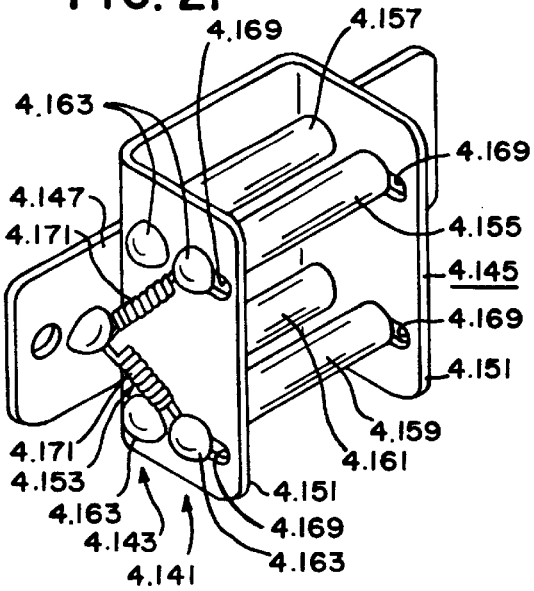
FIG. 21 is a perspective view of another preferred embodiment of the apparatus of the present invention.
Figure 22:
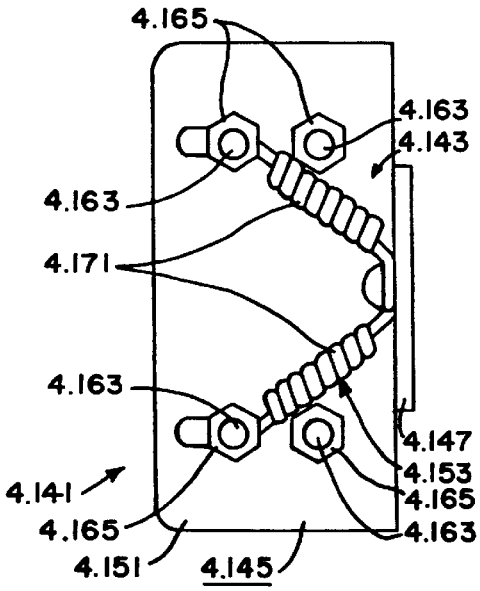
FIG. 22 is a side elevational view of the apparatus of FIG. 21, the opposite side being substantially a mirror image thereof.
Figure 23:
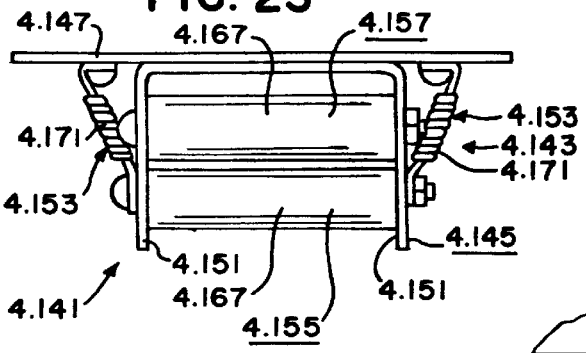
FIG. 23 is a top plan view of the apparatus of FIG. 21, the bottom plan being substantially a mirror image thereof.

Each gate member 3.97 may include a bolt 3.99 for extending between the opposite ear members 3.95, and a nut 3.101 screwably attached to the bolt 3.99, for securing the bolt 3.99 to the ear members 3.95, as clearly shown in FIGS. 16 and 19. In addition, each gate member 3.97 may include a hollow plastic sleeve 3.103, or the like, positioned over the bolt 3.99 to act as a roller and allow that gate member 3.97 to easily slide over the bar 83, etc.

The ear members 3.95 are preferably made as a integral, one-piece body 3.105 of sheet metal or the like bent or otherwise formed with a bight or base portion 3.107 extending between and joining the ear members 3.95. The magnetic means 3.44 is preferably cemented or otherwise fixedly and securely attached to the base portion 3.107 of the body 3.105. The body 3.105 could be constructed with walls or flanges for extending entirely around, securely holding, and protecting the sides of the magnetic means 3.44.

It should be noted that the body 3.105 has been illustrated in the drawings as being specifically adapted to receive a generally square or rectangular shaped magnetic means 3.44, the body 3.105 can be easily adapted to receive a generally circular or ring-shaped magnetic means, etc., as will now be apparent to those skilled in the art.

Figure 20:
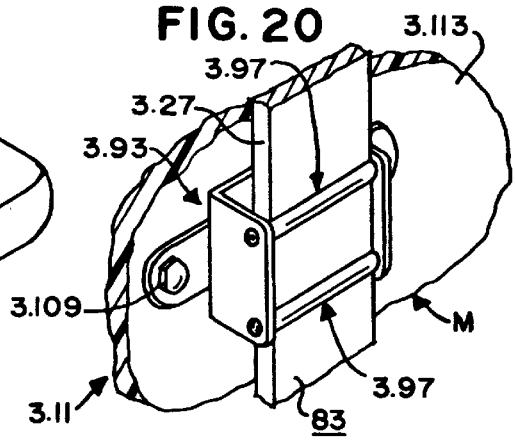
FIG. 20 is a perspective view of a portion of the rear of FIG. 17.

The apparatus 3.11 includes mounting means for mounting the securing means to the portable massaging machine M and coacting with the securing means for adjustably and removably mounting the portable massaging machine M relative to the support member. While the mounting means may be of various different physical designs, the preferred embodiment thereof is shown in FIGS. 19 and 20 preferably simply includes bolt assemblies 3.109 for bolting the guide means 3.93, and thus the magnetic means 3.44 of the securing means, to the portable massaging machine M. Thus, each bolt assembly 3.109 may include a bolt 3.111 for passing through the back wall 3.113, etc., of the portable massaging machine M and through a portion of the body 3.105, and a nut 3.115 for securing the bolt 3.111 to the back wall 3.113 of the portable massaging machine M and to the body 3.105. The body 3.105 preferably includes tab members 3.117 extending from opposite sides the base portion 3.107, with each tab member 3.117 having an aperture 3.119 therethrough for allowing the shaft portion of each bolt 3.111 to extend therethrough as clearly shown in FIG. 19. The tab members 3.117 may consist of a single, elongated metal bar welded or otherwise securely attached to the base portion 3.107 as shown in the drawings. However, it should be noted that the tab members 3.117 could be constructed as an integral, one-piece unit with the base portion 3.107 and ear members 3.95, etc.

The apparatus 3.11 preferably includes handle means 3.121 for attachment to the portable massaging machine M and for allowing the user of the portable massaging machine M to easily move the portable massaging machine M on the elongated bar 83 of the chair S even while sitting on the seat portion 81 of the chair S. For example, the portable massaging machine M may be of the type having grips 3.123 on the opposite sides thereof and the handle means 3.121 preferably includes an elongated first handle portion 3.125 for attachment to one of the grips 3.123, and an elongated second handle portion 3.127 for attachment to the other grip 3.123 (see, in general, FIG. 17). The specific construction of the handle portions 3.125, 3.127 may vary. For example, the proximal end of each handle portion 3.125, 3.127 may have an externally threaded boss portion 3.129 for extending through an aperture 3.131 in each grip 3.123, and a nut 3.133 for screwing onto the boss portion 3.129 to secure the respective handle portion 3.125, 3.127 to the respective grips 3.123 as will now be apparent to those skilled in the art. In addition, the handle portions 3.125, 3.127 may be constructed as separate, individual units, but are preferably joined together by a bight portion 3.135 and may be constructed as a one-piece, integral unit, etc. When mounted on the chair S, the bight portion 3.135 preferably extends behind the bar 83 as clearly shown in FIG. 17 to provide the user of the present invention with additional options to grab and move the combined portable massaging machine M and magnetic means 3.44, etc., up and down on the elongated bar 83, etc.

The operation and use of the apparatus 3.11 of the present invention is quite simple and basically similar to the operation and use of the apparatus 11 discussed hereinabove. The first step may be to fix the body 3.105 to the portable massaging machine M by, for example, extending the bolts 3.111 through the back wall 3.113 of the portable massaging machine M and the apertures 3.119 in the tab members 3.117, and then screwing the nuts 3.115 onto the bolts 3.111. The portable massaging machine M can then be mounted on the chair S by merely inserting the elongated bar 83 into and through the void 3.98, whereupon the magnetic means 3.44, in combination with the ear members 3.95 and the gate members 3.97, will hold the portable massaging machine M in any desired position relative to the elongated bar 83. With the handle portions 3.125, 3.127 attached to the portable massaging machine M as hereinabove described, the user can easily move the combined portable massaging machine M and magnetic means 3.44, etc., up and down on the elongated bar 83 to position the massaging fingers 19 of the portable massaging machine M at any desired location, depending on the height of the user, the specific area of the user's back it is desired to massage, etc., by merely grabbing the handle portions 3.125, 3.127 or bight portion 3.135 while sitting on the seat portion 81 of the chair S, etc. If treatment is desired for problems in the thigh and leg areas, the massaging action can be applied to the lower lumbar vertebrae housing the nerves which supply these areas. Similarly, by raising the position of the machine to a higher level, it will massage vertebrae which house nerves supplying abdominal, thoracic or neck areas.

Another preferred embodiment of the apparatus of the present invention is shown in FIGS. 21–24, and identified by the numeral 4.11. The apparatus 4.11 is also specifically designed for mounting a portable massaging machine M including massaging fingers 19 (see, in general, FIGS. 5 and 17), to a support member, such as a typical secretarial-type chair S, or the like, having a seat portion 81 with a relatively rigid spine or elongated bar 83 extending upward from the back of the seat portion 81 to which a backrest portion is typically slidably mounted (see, in general, FIGS. 6 and 17). However, when used with the apparatus 4.11, the backrest portion is removed from the bar 83. The bar 83 may be made entirely from a metal bar or the like. In addition, depending on the original height or length of the bar 83, an extension might be welded or otherwise attached to the upper end of the bar 83 to extend the effective height thereof.

Figure 24:
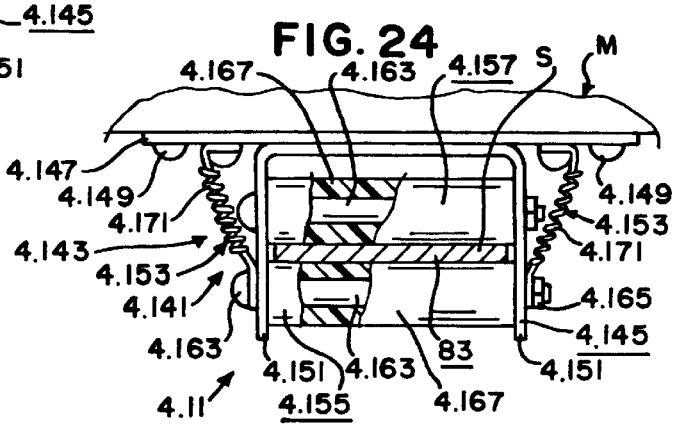
FIG. 24 is a top plan view of the apparatus of FIG. 21, shown combined with a portion of a portable massaging machine and a portion of a support member.

The apparatus 4.11 includes securing means 4.141 for securing the portable massaging machine M to the support member (e.g., to the bar 83 of the chair S as shown in FIG. 24).

The securing means 4.141 includes clamp means 4.143 for attachment to the portable massaging machine M and for movably attaching the portable massaging machine M to the support member (e.g., to the bar 83 of the chair S as shown in FIG. 24). The clamp means 4.143 preferably includes a body 4.145 for being secured to the portable massaging machine M. The body 4.145 may include a base 4.147 for being attached to the back wall of the portable massaging machine M by bolts 4.149 or the like (see FIG. 24). The body 4.145 preferably includes a pair of spaced-apart ear members 4.151 extending from the base 4.147 as clearly shown in FIGS. 21–24. The ear members 4.151 may be constructed as integral, one-piece units with the base 4.147 or may be constructed as an integral, one-piece U-shaped unit welded or otherwise fixedly attached to the base 4.147 as clearly shown in FIGS. 21, 23, and 24.

The clamp means 4.143 preferably includes spring means 4.153 for springably clamping a portion of the support member (e.g., a portion of the bar 83 of the chair S) to the body 4.145 of the securing means 4.141.

The clamp means 4.143 preferably includes a first clamp member 4.155 and a second clamp member 4.157, and the spring means 4.153 is designed to urge the first clamp member 4.155 toward the second clamp member 4.157 to allow a portion of the support member (e.g., a portion of the bar 83 of the chair S) to be clamped between the first and second clamp members 4.155, 4.157 (see, in general, FIG. 24). In addition, the clamp means 4.143 preferably includes a third clamp member 4.159 and a fourth clamp member 4.161 spaced below the first and second clamp members 4.155, 4.157, and the spring means 4.153 is designed to also urge the third clamp member 4.159 toward the fourth clamp member 4.161 to allow a portion of the support member (e.g., a portion of the bar 83 of the chair S) to be clamped between the third and fourth clamp members 4.159, 4.161.

Each clamp member 4,155, 4.157, 4.159, 4.161 may include a bolt 4.163 for extending between the opposite ear members 4.151, and a nut 4.165 screwably attached to the bolt 4.163, for securing the bolt 4.163 to the ear members 4.151. In addition, each clamp member 4,155, 4.157, 4.159, 4.161 may include a hollow plastic sleeve 4.167, or the like, positioned over the bolt 4.163 to act as a roller and allow the clamp members 4,155, 4.157, 4.159, 4.161 to easily slide over the bar 83, etc.

The first and third clamp members 4.155, 4.159 are preferably slidably mounted to the ear members 4.151 to allow the spring means 4.153 to urge the first and third clamp members 4.155, 4.159 toward the second and fourth clamp members 4.157, 4.161, respectively. More specifically, the ear members 4.151 preferably have opposed slots 4.169 therethrough for receiving the bolts 4.163 of the first and third clamp members 4.155, 4.159 with the slots 4.169 located so as to position the first and third clamp members 4.155, 4.159 substantially opposite the second and fourth clamp members 4.157, 4.161, respectively. The spring means 4.153 preferably includes a spring member 4.171 attached between the base 4.147 and each end of each bolt 4.163 of the first and third clamp members 4.155, 4.159 to normally urge the first and third clamp members 4.155, 4.159 toward the second and fourth clamp members 4.157, 4.161, respectively, as will now be apparent to those skilled in the art. The strength of the spring members 4.171 can vary, depending on the weight of the portable massaging machine M to be attached to the support member, etc., as will now be apparent to those skilled in the art. Also, while each spring member 4.171 preferably consist of a substantially typical coil spring as shown in the drawings, each spring member 4.171 could consist of various other standard spring designs, etc., now apparent to those skilled in the art.

The operation and use of the apparatus 4.11 of the present invention is quite simple and basically similar to the operation and use of the apparatus 11 discussed hereinabove. The first step may be to secure the body 4.145 to the portable massaging machine M by, for example, extending the bolts 4.149 through the base 4.147 of the body 4.145 of the securing means 4.141 and into the back wall of the portable massaging machine M (see, in general, FIG. 24). The portable massaging machine M can then be mounted on the chair S by merely inserting the elongated bar 83 between the first and second clamp members 4.155, 4.157 and the third and fourth clamp members 4.159, 4.161, whereupon the spring members 4.171 will urge the first and third clamp members 4.155, 4.159 and the second and fourth clamp members 4.157, 4.161, respectively, to hold the portable massaging machine M in any desired position relative to the elongated bar 83. With handle means, such as the handle means 3.121 disclosed hereinabove, attached to the portable massaging machine M, the user of the apparatus 4.11 can easily move the combined portable massaging machine M and securing means 4.141 up and down on the elongated bar 83 to position the massaging fingers 19 of the portable massaging machine M at any desired location, depending on the height of the user, the specific area of the user's back it is desired to massage, etc., by merely grabbing the handle means while sitting on the seat portion 81 of the chair S, etc. If treatment is desired for problems in the thigh and leg areas, the massaging action can be applied to the lower lumbar vertebrae housing the nerves which supply these areas. Similarly, by raising the position of the machine to a higher level, it will massage vertebrae which house nerves supplying abdominal, thoracic or neck areas.

Another preferred embodiment of the apparatus of the present invention is shown in FIGS. 25–29, and identified by the numeral 5.11. The apparatus 5.11 is also specifically designed for mounting a portable massaging machine M including massaging fingers 19 (see, in general, FIGS. 5 and 17), to a support member, such as a typical secretarial-type chair S, or the like, having a seat portion 81 with a relatively rigid spine or elongated bar 83 extending upward from the back of the seat portion 81 to which a backrest portion is typically slidably mounted (see, in general, FIGS. 6 and 17). However, when used with the apparatus 5.11, the backrest portion is removed from the bar 83. The bar 83 may be made entirely from a metal bar or the like. In addition, depending on the original height or length of the bar 83, an extension might be welded or otherwise attached to the upper end of the bar 83 to extend the effective height thereof.

The apparatus 5.11 includes securing means 5.141 for securing the portable massaging machine M to the support member (e.g., to the bar 83 of the chair S as shown in FIG. 24).

Figure 25:
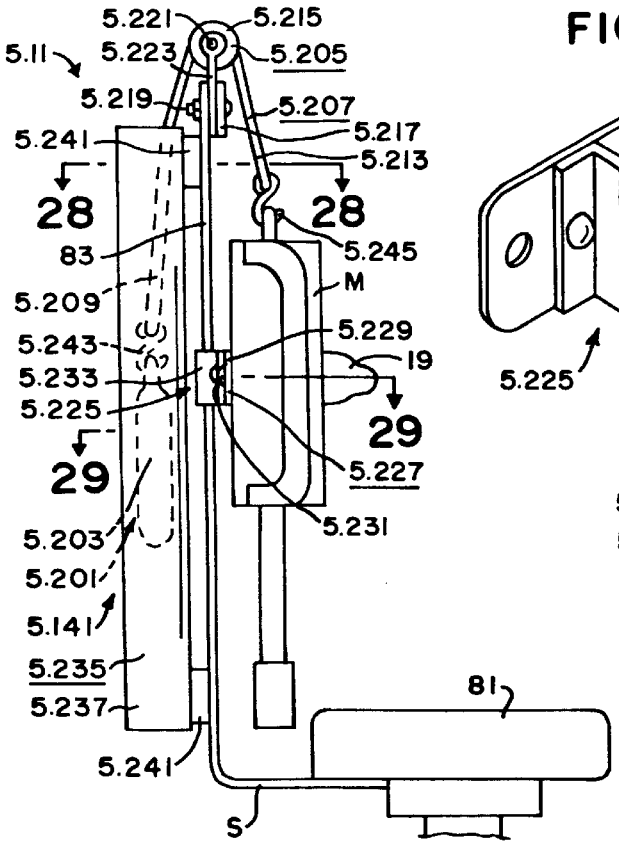
FIG. 25 is an elevational view of another preferred embodiment of the apparatus of the present invention.
Figure 26:
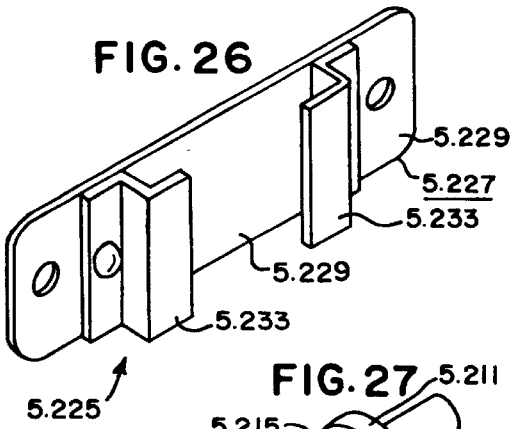
FIG. 26 is a perspective view of part of the apparatus of FIG. 25.
Figure 27:
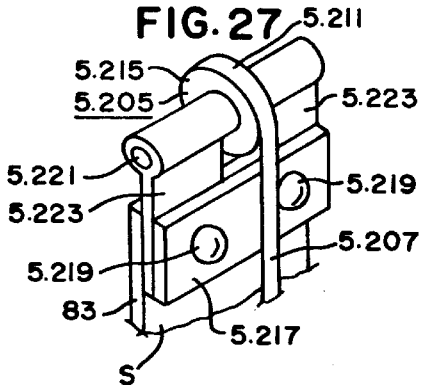
FIG. 27 is a perspective view of a portion of the apparatus of FIG. 25.
Figure 28:
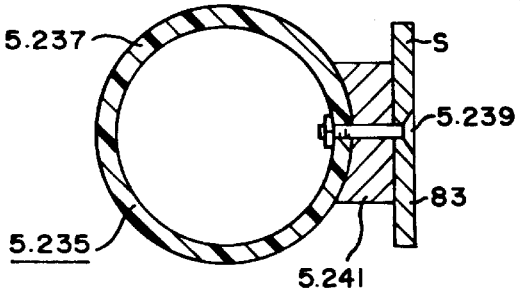
FIG. 28 is a sectional view substantially as taken on line 28—28 of FIG. 25, on an enlarged scale and with portions omitted for clarity.
Figure 29:
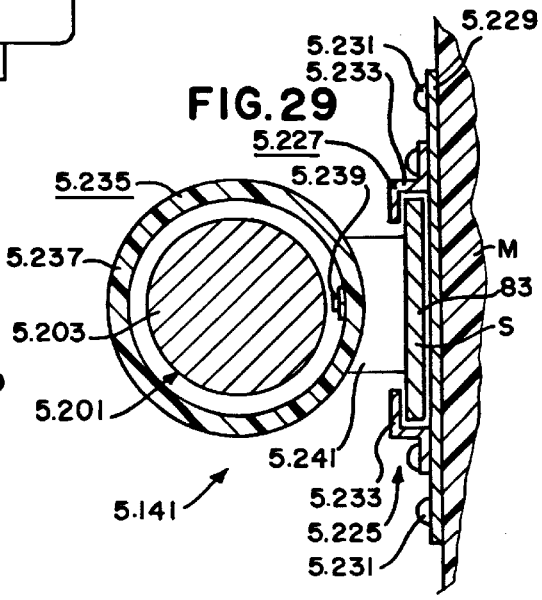
FIG. 29 is a sectional view substantially as taken on line 29—29 of FIG. 25, on an enlarged scale and with portions broken away or omitted for clarity.

The securing means 5.141 includes counterweight means 5.201 for attachment to the portable massaging machine M and for movably attaching the portable massaging machine M to the support member (e.g., to the bar 83 of the chair S as shown in FIG. 25). The counterweight means 5.201 preferably includes a weight member 5.203, a guide member 5.205 for mounting to a portion of the support member (e.g., to the bar 83 of the chair S as shown in FIG. 25) above the portable massaging machine M, and a cable 5.207 having a first end 5.209 attached to the weight member 5.203, a midportion 5.211 extending over the guide member 5.205, and a second end 5.213 attached to the portable massaging machine M.

The guide member 5.205 preferably includes a sheave or pulley 5.215 for rotatable attachment to a portion of the support member (i.e., to the top end of the bar 83 of the chair S) above the portable massaging machine M. The pulley 5.125 typically has a grooved rim for receiving and retaining the midportion 5.211 of the cable 5.207. The guide member 5.205 may include means for attaching the pulley 5.215 to the support member. For example, the guide member 5.205 may include a plate member 5.217 for fixed attachment to the top end of the bar 83 by way of bolts 5.219 or the like, an axle 5.221 attached to the center of the pulley 5.215, and coupling members 5.223 for pivotally attaching the axle 5.221 to the plate member 5.217 (or for being clamped by the plate member 5.217 to the top of the bar 83, etc.). The specific construction and design of the means for attaching the pulley 5.215 to the support member may vary as will now be apparent to those skilled in the art.

The securing means 5.141 preferably includes slide means 5.225 for slidably engaging a portion of the support member, e.g., the bar 83 of the chair S. The slide means 5.225 preferably includes a body 5.227 for being secured to the portable massaging machine M. The body 5.227 may include a base 5.229 for being attached to the back wall of the portable massaging machine M by bolts 5.231 or the like (see FIG. 29). The body 5.227 preferably includes a pair of spaced-apart finger members 5.233 extending from the base 5.229 as clearly shown in FIGS. 26 and 29 for extending around a portion of the opposite side edges of the bar 83 to thereby coact with the base 5.229 to form a channel to slidably receive the bar 83 and secure the body 5.227, and thus the portable massaging machine M, to the bar 83 as will now be apparent to those skilled in the art. The finger members 5.233 may be constructed as integral, one-piece units with the base 5.229 or may be constructed as an individual members bolted, welded or otherwise fixedly attached to the base 5.229. The surfaces of the finger members 5.233 that engage the bar 83 may be coated, either partially or completely, with a suitable plastic such as nylon, or the like, to both allow the finger members 5.233 to easily slide along the bar 83 and deaden any sound created by the finger members 5.233 sliding along the bar 83, etc.

The apparatus 5.11 may include cover means 5.235 for covering the weight member 5.203 of the counterweight means 5.201 to shield the user of the apparatus 5.11 from the weight member 5.203 as the apparatus 5.11 is used. The cover means 5.235 may also act to guide the weight member 5.203 as the weight member 5.203 is moved between raised and lowered positions. The cover means 5.235 preferably includes a hollow tube 5.237 sized to slidably receive the weight member 5.203. The tube 5.237 is preferably fixedly attached to the support member, e.g., to the bar 83 by way of bolts 5.239, spacers 5.241, or the like, in a position to receive the weight member 5.203 and completely cover the weight member 5.203 as the weight member 5.203 is moved between raised and lowered positions when the portable massaging machine M is moved between raised and lowered positions. The tube 5.237 may be constructed from a length of typical PVC (polyvinyl chloride) pipe or the like.

The operation and use of the apparatus 5.11 of the present invention is quite simple and basically similar to the operation and use of the apparatus 11 discussed hereinabove. The first step may be to secure the body 5.227 of the slide means 5.227 to the portable massaging machine M by, for example, extending the bolts 5.231 through the base 5.229 of the body 5.227 of the slide means 5.225 and into the back wall of the portable massaging machine M (see, in general, FIG. 29). The portable massaging machine M can then be mounted on the chair S by merely inserting the elongated bar 83 between the finger members 5.233, attach the first end 5.209 of the cable 5.207 to the weight member 5.203 by way of a hook assembly 5.243 or the like, guide the midportion 5.211 of the cable 5.207 over the pulley 5.215, and attach the second end 5.213 of the cable 5.207 to the portable massaging machine M by way of a hook assembly 5.245 or the like, to thereby hold the portable massaging machine M in any desired position relative to the elongated bar 83. With handle means, such as the handle means 3.121 disclosed hereinabove, attached to the portable massaging machine M, the user of the apparatus 5.11 can easily move the combined portable massaging machine M and slide means 5.225 up and down on the elongated bar 83 to position the massaging fingers 19 of the portable massaging machine M at any desired location, depending on the height of the user, the specific area of the user's back it is desired to massage, etc., by merely grabbing the handle means while sitting on the seat portion 81 of the chair S, etc. If treatment is desired for problems in the thigh and leg areas, the massaging action can be applied to the lower lumbar vertebrae housing the nerves which supply these areas. Similarly, by raising the position of the machine to a higher level, it will massage vertebrae which house nerves supplying abdominal, thoracic or neck areas.

Figure 30:
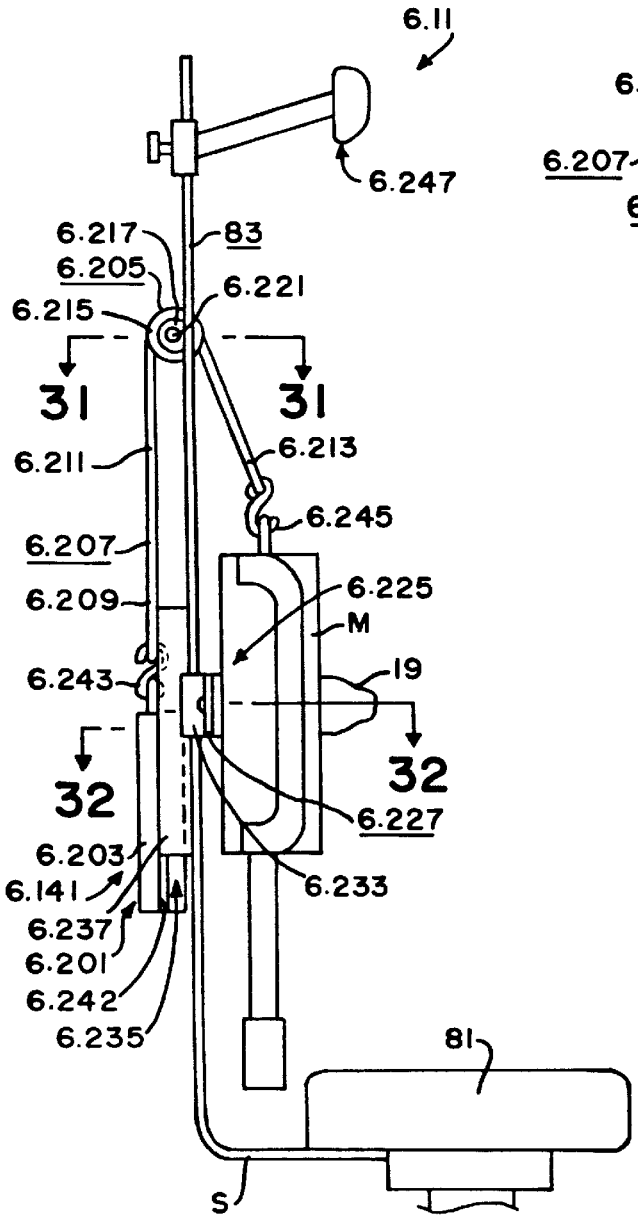
FIG. 30 is an elevational view of another preferred embodiment of the apparatus of the present invention.
Figure 31:
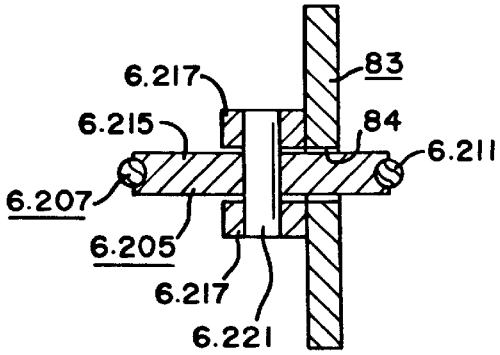
FIG. 31 is a sectional view substantially as taken on line 31—31 of FIG. 30 on an enlarged scale and with portions broken away or omitted for clarity.
Figure 32:
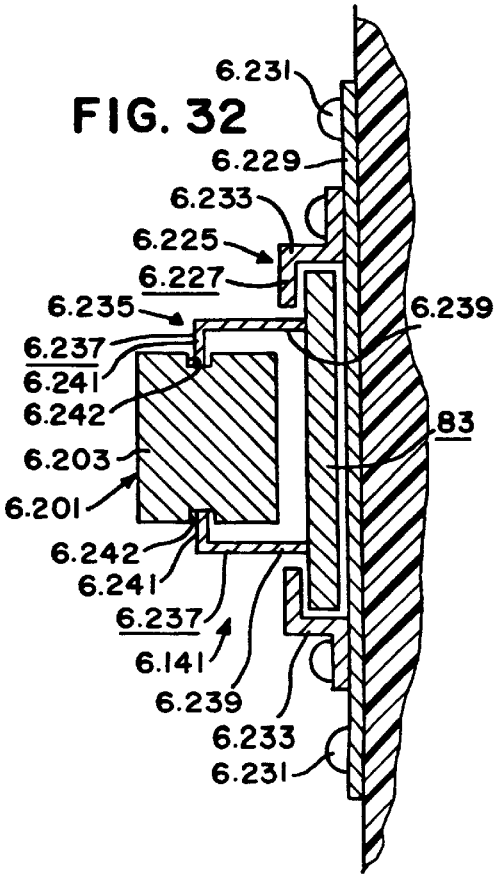
FIG. 32 is a sectional view substantially as taken on line 32—32 of FIG. 30 on an enlarged scale and with portions broken away or omitted for clarity.
Figure 33:
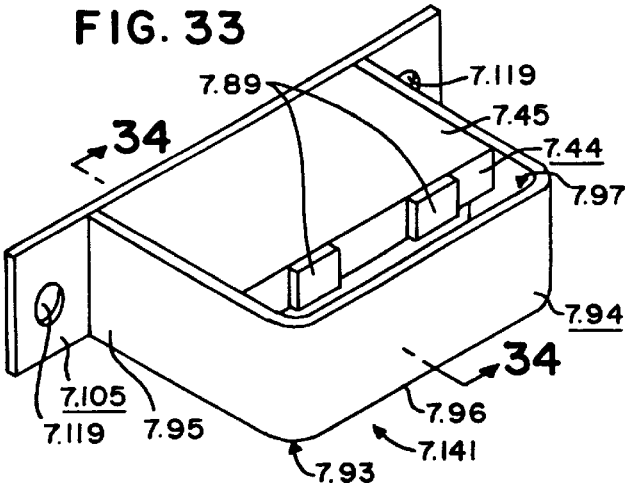
FIG. 33 is a perspective view of another embodiment of the securing means of the apparatus of the present invention.
Figure 34:
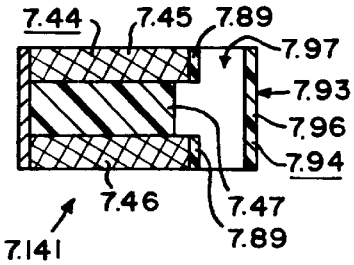
FIG. 34 is a sectional view substantially as taken on line 34—34 of FIG. 33.

Another preferred embodiment of the apparatus of the present invention is shown in FIGS. 30–32, and identified by the numeral 6.11. The apparatus 6.11 is also specifically designed for mounting a portable massaging machine M including massaging fingers 19 (see, in general, FIG. 30), to a support member, such as a typical secretarial-type chair S, or the like, having a seat portion 81 with a relatively rigid spine or elongated bar 83 extending upward from the back of the seat portion 81 to which a backrest portion is typically slidably mounted. However, when used with the apparatus 6.11, the backrest portion is removed from the bar 83. The bar 83 may be made entirely from a metal bar or the like. In addition, depending on the original height or length of the bar 83, an extension might be welded or otherwise attached to the upper end of the bar 83 to extend the effective height thereof.

The apparatus 6.11 includes securing means 6.141 for securing the portable massaging machine M to the support member (e.g., to the bar 83 of the chair S as shown in FIGS. 30–32).

The securing means 6.141 may be similar to the securing means 5.141, and includes counterweight means 6.201 for attachment to the portable massaging machine M and for movably attaching the portable massaging machine M to the support member (e.g., to the bar 83 of the chair S as shown in FIG. 25). The counterweight means 6.201 preferably includes a weight member 6.203, a guide member 6.205 for mounting to a portion of the support member (e.g., to the bar 83 of the chair S as shown in FIG. 25) above the portable massaging machine M, and a cable 6.207 having a first end 6.209 attached to the weight member 6.203, a midportion 6.211 extending over the guide member 6.205, and a second end 6.213 attached to the portable massaging machine M.

The guide member 6.205 preferably includes a sheave or pulley 6.215 for rotatable attachment to a portion of the support member (e.g., to portion of the bar 83 of the chair S) above the portable massaging machine M. The pulley 6.125 typically has a grooved rim for receiving and retaining the midportion 6.211 of the cable 6.207. The guide member 6.205 may include means for attaching the pulley 6.215 to the support member. For example, the guide member 6.205 may include a ear members 6.217 for fixed attachment to the bar 83 by way of welding or the like, an axle 6.221 attached to the center of the pulley 6.215 and extending through the ear members 6.217 as clearly shown in FIG. 31. The bar 83 preferably has a slot 84 therethrough, and the pulley 6.215 and midportion 6.211 of the cable 6.207 preferably extend through the slot 84 as clearly shown in FIGS. 30 and 31. The specific construction and design of the means for attaching the pulley 6.215 to the support member may vary as will now be apparent to those skilled in the art.

The securing means 6.141 preferably includes first slide means 6.225 for attachment to the portable massaging machine M and for slidably engaging a portion of the support member, e.g., the bar 83 of the chair S. The first slide means 6.225 may be substantially identical to the slide means 5.225, and preferably includes a body 6.227 for being secured to the portable massaging machine M. The body 6.227 may include a base 6.229 for being attached to the back wall of the portable massaging machine M by bolts 6.231 or the like (see FIG. 31). The body 6.227 preferably includes a pair of spaced-apart finger members 6.233 extending from the base 6.229 as clearly shown in FIG. 30 for extending around a portion of the opposite side edges of the bar 83 to thereby coact with the base 6.229 to form a channel to slidably receive the bar 83 and secure the body 6.227, and thus the portable massaging machine M, to the bar 83 as will now be apparent to those skilled in the art. The finger members 6.233 may be constructed as integral, one-piece units with the base 6.229 or may be constructed as an individual members bolted, welded or otherwise fixedly attached to the base 6.229. The surfaces of the finger members 6.233 that engage the bar 83 may be coated, either partially or completely, with a suitable plastic such as nylon, or the like, to both allow the finger members 6.233 to easily slide along the bar 83 and deaden any sound created by the finger members 6.233 sliding along the bar 83, etc.

The securing means 6.141 preferably includes second slide means 6.235 for attachment to a portion of the support member, e.g., the bar 83 of the chair S, and for slidably engaging a the weight member 6.203. The second slide means 6.235 preferably includes a pair of finger members 6.237 with each finger member 6.237 having a first end 6.239 for attachment to the bar 83 by welding or the like, and having a second end 6.241 for engaging a respective one of a pair of slots 6.241 formed in opposite sides of the weight member 6.203 to hold the weight member 6.203 relative to the bar 83 and guide the weight member 6.203 as the weight member 6.203 is moved between raised and lowered positions.

The operation and use of the apparatus 6.11 of the present invention is quite simple and basically similar to the operation and use of the apparatus 11 discussed hereinabove. The first step may be to secure the body 6.227 of the slide means 6.227 to the portable massaging machine M by, for example, extending the bolts 6.231 through the base 6.229 of the body 6.227 of the slide means 6.225 and into the back wall of the portable massaging machine M (see, in general, FIG. 32). The portable massaging machine M can then be mounted on the chair S by merely inserting the elongated bar 83 between the finger members 6.233, attach the first end 6.209 of the cable 6.207 to the weight member 6.203 by way of a hook assembly 6.243 or the like, guide the midportion 6.211 of the cable 6.207 over the pulley 6.215 and through the slot 84, and attach the second end 6.213 of the cable 6.207 to the portable massaging machine M by way of a hook assembly 6.245 or the like, to thereby hold the portable massaging machine M in any desired position relative to the elongated bar 83. With handle means, such as the handle means 3.121 disclosed hereinabove, attached to the portable massaging machine M, the user of the apparatus 6.11 can easily move the combined portable massaging machine M and slide means 6.225 up and down on the elongated bar 83 to position the massaging fingers 19 of the portable massaging machine M at any desired location, depending on the height of the user, the specific area of the user's back it is desired to massage, etc., by merely grabbing the handle means while sitting on the seat portion 81 of the chair S, etc. An adjustable head rest 6.247 can be slidably mounted on the bar 83 as clearly shown in FIG. 30 if desired. If treatment is desired for problems in the thigh and leg areas, the massaging action can be applied to the lower lumbar vertebrae housing the nerves which supply these areas. Similarly, by raising the position of the machine to a higher level, it will massage vertebrae which house nerves supplying abdominal, thoracic or neck areas.

Another preferred embodiment of the securing means for adjustably securing the portable massaging machine M relative to a support member is shown in FIGS. 33–36 and identified by the numeral 7.141. The securing means 7.141 is specifically designed for mounting a portable massaging machine M to a support member such as a typical secretarial type chair S, or the like, having a seat portion 81 with a relatively rigid spine or elongated bar 83 extending upward from the back of the seat portion 81 (see, e.g., FIG. 17) to which a backrest portion is typically slidably mounted. However, when used with the securing means 7.141, the backrest portion is removed from the bar 83. As hereinabove discussed, the bar 83 preferably has a magnetic portion 3.27 (i.e., a portion that is capable of being magnetized or attracted by a magnet), and is preferably made entirely from a magnetic material (i.e., a steel bar or the like). In addition, depending on the original height or length of the bar 83, a magnetic extension might be welded or otherwise attached to the upper end of the bar 83 to extend the effective height thereof.

The securing means 7.141 preferably includes a magnet or magnetic means 7.44 for movable attachment to the magnetic portion 3.27 of the bar 83. The magnetic means 7.44 preferably includes a pair of off-the-shelf permanent magnets 7.45, 7.46 separated by a non-magnetic spacer 7.47 (see FIG. 34). The magnets 7.45, 7.46 and spacer 7.47 are preferably cemented or otherwise fixedly attached to a body 7.105 The body 7.105 preferably consist of an elongated metal plate or the like having apertures 7.119 through each end thereof for allowing the securing means 7.141 to be attached to the portable massaging machine M by bolt assemblies 7.109 or the like (see FIGS. 35 and 36. It should be noted that the body 7.105 could be fixedly attached to the portable massaging machine M by glue, cement, etc., as will now be apparent to those skilled in the art.

The securing means 7.141 preferably includes guide means 7.93 for guiding the bar 83 relative to the magnets 7.45, 7.46. The guide means 7.93 preferably includes a U-shaped bracket 7.94 having ends 7.95 that are fixedly attached to the body 7.105 by being cemented, glued, bolted, etc., thereto, and having a bight portion 7.96 spaced from the magnets 7.45, 7.46 to from a void or gap 7.97 therebetween through which the bar 83 can extend (see, in general, FIGS. 36). The cross-sectional area of the gap 7.97 is preferably shaped and sized slightly larger than the cross sectional area of the bar 83 to guidingly and slidably receive the bar 83.

One or more plates 7.89 may cover all or preferably portions of the face of each magnet 7.45, 7.46 (i.e., the side of each magnet 7.45, 7.46 for being positioned against and attracted to the bar 83) to reduce wear, noise, etc., between the face of each magnet 7.45, 7.46 and the bar 83 as will now be apparent to those skilled in the art. The plates 7.89 are preferably constructed out of a suitable plastic such as nylon, etc., and glued or otherwise fixedly attached to the face of the magnets 7.45, 7.46.

Figure 35:
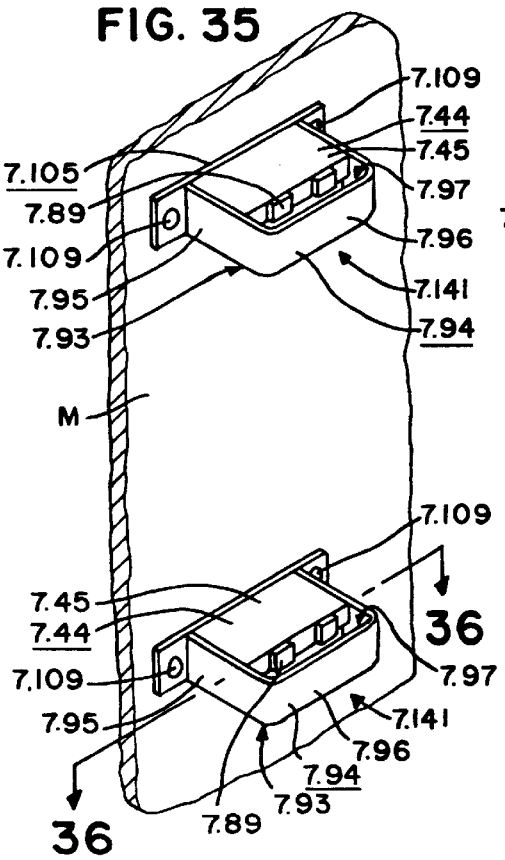
FIG. 35 is a somewhat diagrammatic perspective view showing a pair of the securing means of FIG. 33 attached to a portion of a portable massaging machine.
Figure 36:
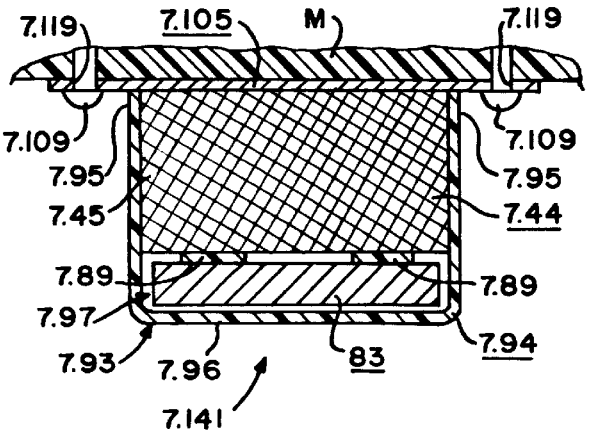
FIG. 36 is a sectional view substantially as taken on line 36—36 of FIG. 35 on a somewhat enlarged scale and shown combined with a portion of a support member.
Figure 37:
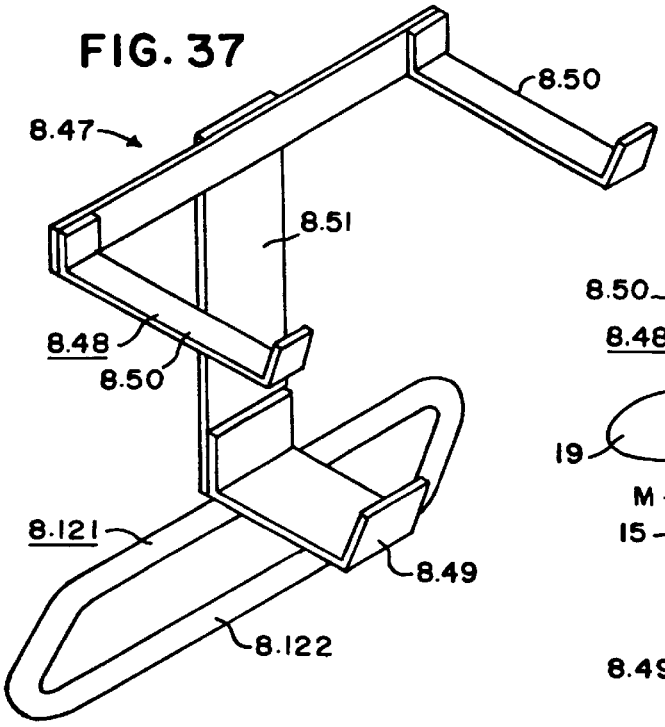
FIG. 37 is a perspective view of another embodiment of the mounting means of the apparatus of the present invention.

While a single securing means 7.141 will adjustably secure the portable massaging machine M to the bar 83, etc., a pair of spaced apart securing means 7.141 attached to the portable massaging machine M as clearly shown in FIG. 35 will more positively secure the portable massaging machine M to the bar 83, etc., and will prevent any pivoting or rocking movement between the bar 83 and the portable massaging machine M as will now be apparent to those skilled in the art.

Figure 38:
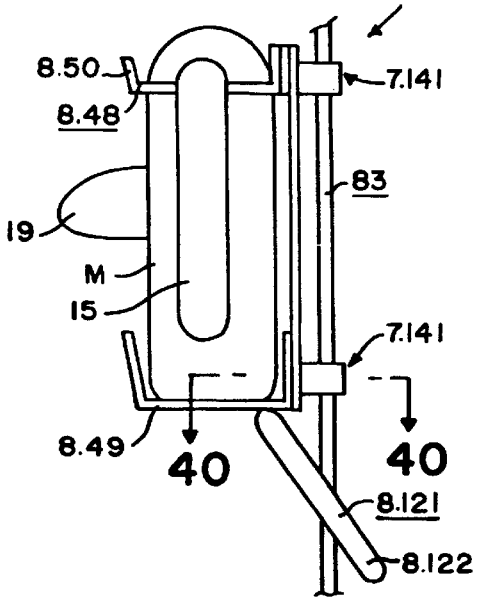
FIG. 38 is an end elevational view of the mounting means of FIG. 37, shown combined with a pair of the securing means of FIG. 33, a portable massaging machine, and a portion of a support member.
Figure 39:
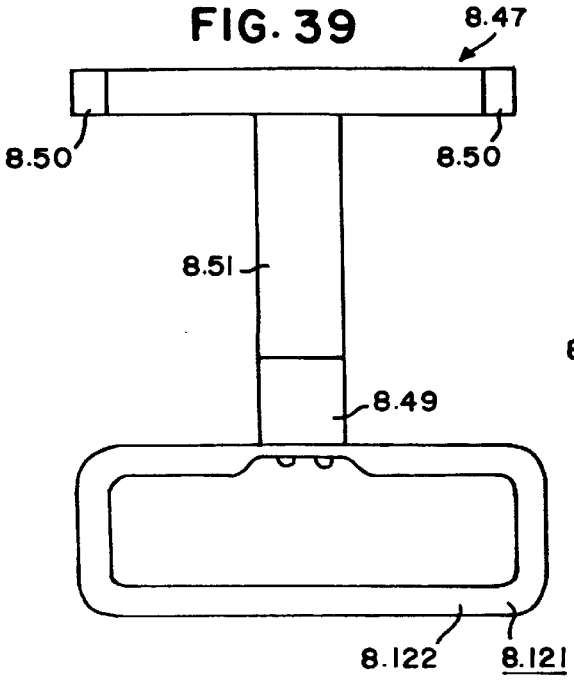
FIG. 39 is a front elevational view of the mounting means of FIG. 37.
Figure 40:
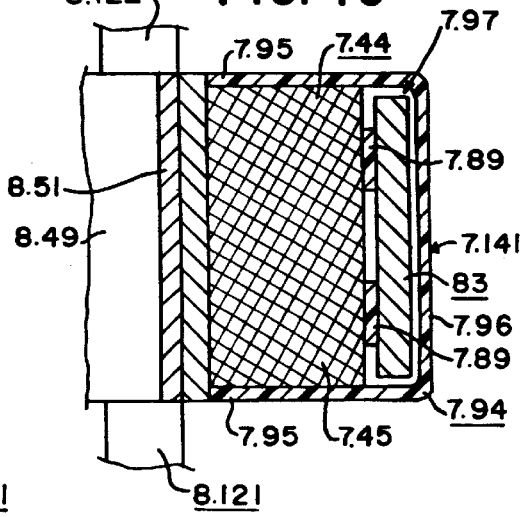
FIG. 40 is a sectional view substantially as taken on line 40—40 of FIG. 38 on an enlarged scale and with portions broken away or omitted for clarity.

Another preferred embodiment of the mounting means for mounting the securing means to the portable massaging machine M is shown in FIGS. 37–40 and identified by the numeral 8.47. The mounting means 8.47 includes a cradle means 8.48 for being securely attached to the portable massaging machine M without requiring any permanent modification of the portable massaging machine M. The cradle means 8.48 preferably includes a lower arm 8.49 for extending beneath or otherwise gripping the lower edge of the housing 13 of the portable massaging machine M, a pair of spaced-apart upper arms 8.50 for extending into or otherwise gripping the handles 15 of the housing 13 of the portable massaging machine M, and a body member or frame 8.51 for joining the lower arm 8.49 and upper arms 8.50 together. Various specific types of securing means can be fixedly attached to the frame 8.51 so that the combined portable massaging machine M and mounting means 8.47 can be movably secured relative to a support member. Thus, for example, the magnetic means 44 or 2.85 could be fixedly attached to the frame 8.51 by being bolted or welded thereof, etc., so that the combined portable massaging machine M and mounting means 8.47 could be used with the body member 25 as will now be apparent to those skilled in the art. Alternatively, the combined magnetic means 3.44 and guide means 3.93 or the securing means 4.141 could be fixedly attached to the frame 8.51 by being bolted or welded thereof, etc., so that the combined portable massaging machine M and mounting means 8.47 could be used with the bar 83 of the chair S as will now be apparent to those skilled in the art. As shown in FIGS. 38 and 40, a pair of the securing means 7.141 may be fixedly attached to the frame 8.51 by welding or the like, with one securing means 7.141 attached adjacent the top of the frame 8.51 and the other securing means 7.141 attached adjacent the lower end of the frame 8.51, so that the combined portable massaging machine M and mounting means 8.47 could be used with the bar 83 of the chair S as will now be apparent to those skilled in the art.

Handle means 8.121 may be attached to the frame 8.51 for allowing the user of the portable massaging machine M to easily move the portable massaging machine M on a support member such as the chair S. The handle means 8.121 may consist of a loop 8.122 attached to the lower end of the frame 8.51 adjacent the lower arm 8.49 and angled so as to allow the user of the present invention to easily grab and move the combined portable massaging machine M and mounting means 8.47 up and down on the elongated bar 83, etc.

Another preferred embodiment of the apparatus of the present invention is shown in FIGS. 41–46, and identified by the numeral 9.11. The apparatus 9.11 is specifically designed for mounting a portable massaging machine M as disclosed hereinabove, to a support member, such as a standard straight-back chair C (see FIG. 41), a secretarial-type chair, a couch, or the like, typically having a seat portion 21 and a back or backrest portion 23.

The apparatus 9.11 includes anchor means 9.24 for being held fixed to the support member (e.g., the chair C) by the person using the apparatus 9.11; a body or backboard member 9.25 attached to the anchor means 9.24; and securing means 9.26 for movably securing the portable massaging machine M to the backboard member 9.25.

The backboard member 9.25 preferably includes a magnetic member or portion 9.27 (i.e., a member or portion that is capable of being magnetized or attracted by a magnet) having a face surface 9.29, a first or lower end 9.30 and a second or upper end 9.31. The first or lower end 9.30 is preferably attached to the anchor means 9.24.

The backboard member 9.25 preferably has a first track or ridge member 9.37 extending generally between the first and second ends 9.33, 9.35 thereof; and a second track or ridge member 9.39 extending generally between the first and second ends 9.33, 9.35 thereof and spaced from and parallel to the first track member 9.37 a sufficient distance to allow the magnetic portion 9.27 to be located between the first and second track members 37, 39. The backboard member 9.25 may be constructed in various manners, out of various materials, in various shapes and sizes, etc. Thus, for example, the magnetic portion 9.27, first track member 9.37 and second track member 9.39 may be machined or bent, or otherwise formed as a one-piece, integral unit out of a relatively thin piece of iron, steel or other metal to which magnets are attracted.

Figure 41:
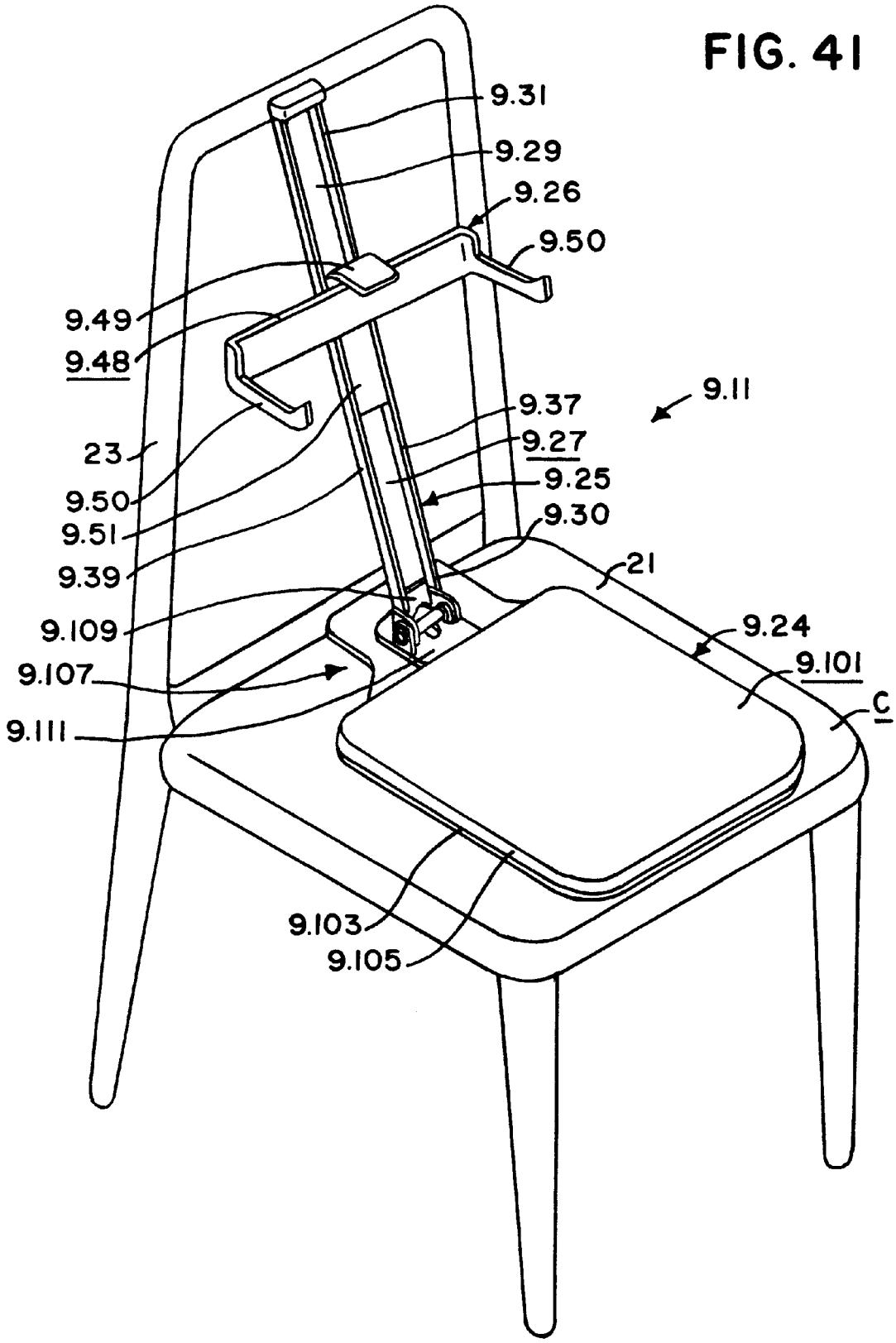
FIG. 41 is a perspective view of another preferred embodiment of the apparatus of the present invention, combined with a chair having a standard backrest portion.
Figures 42, 43:
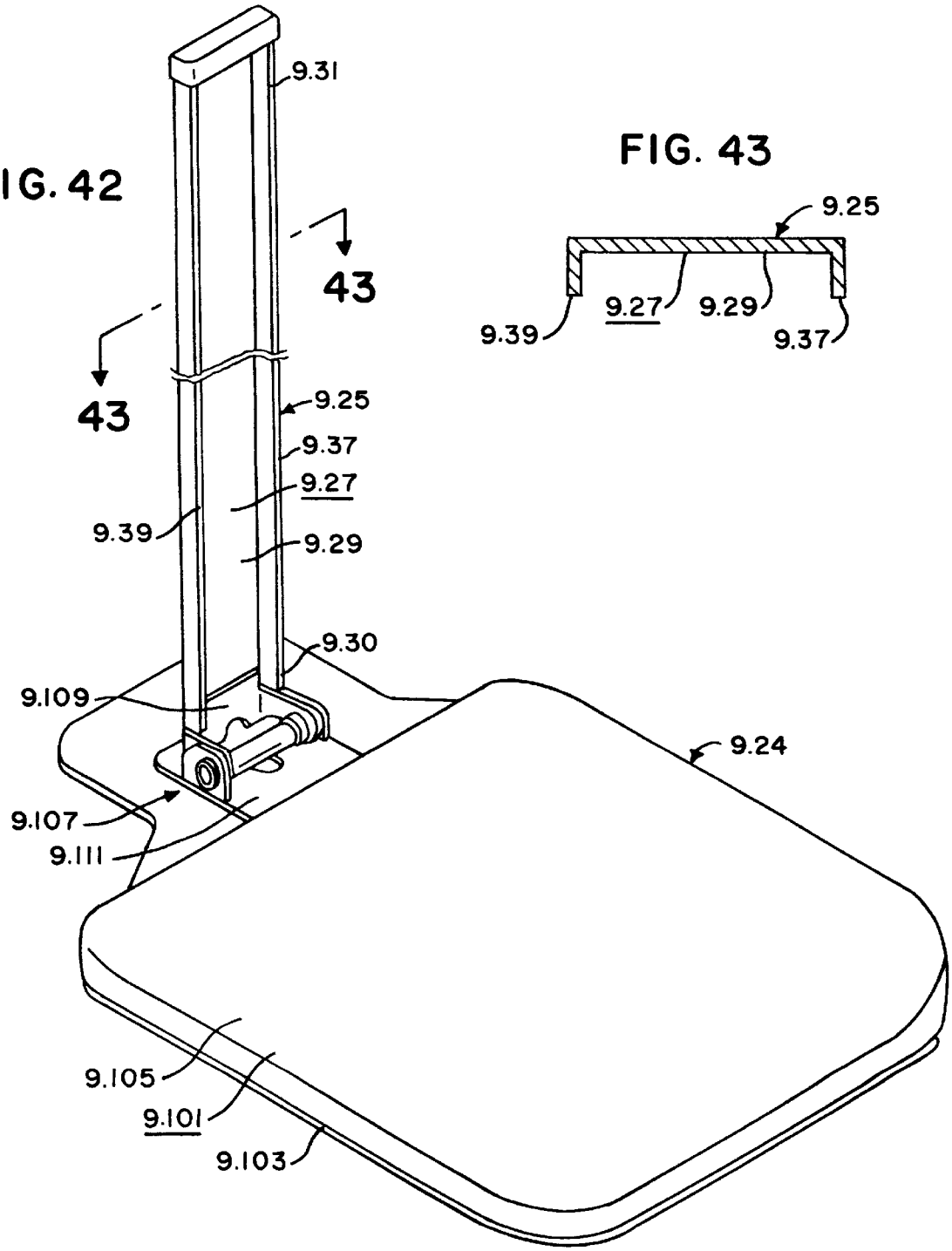
FIG. 42 is a perspective view of the anchor means and backboard member of the apparatus of FIG. 41, with portions thereof broken away for clarity.
FIG. 43 is a sectional view substantially as taken on line 43—43 of FIG. 42 on an somewhat enlarged scale and with portions thereof omitted for clarity.
Figure 44:
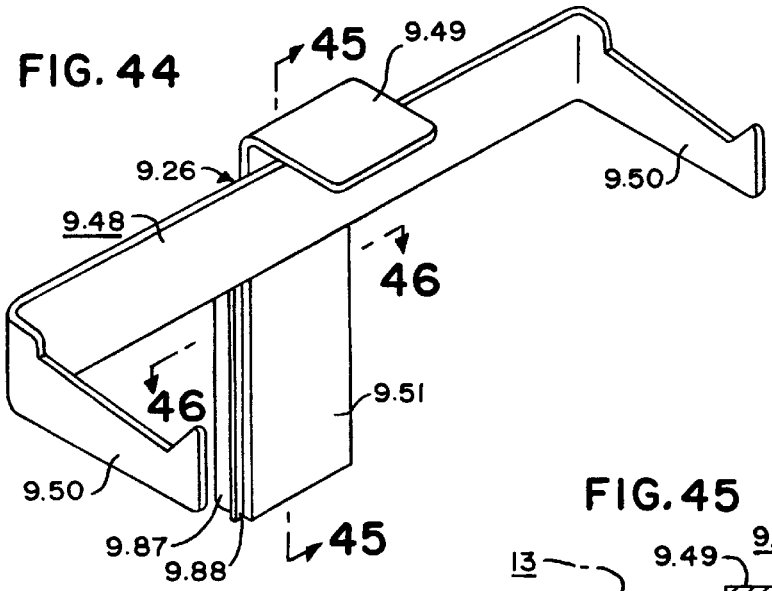
FIG. 44 is a perspective view of the securing means of the apparatus of FIG. 41.
Figure 45:
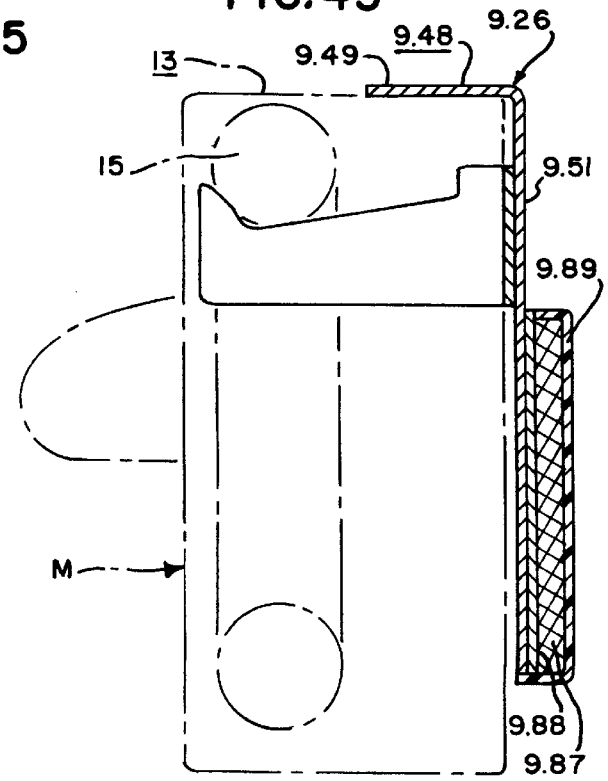
FIG. 45 is a sectional view substantially as taken on line 45—45 of FIG. 44 and showing a portable massaging machine attached thereto.
Figure 46:
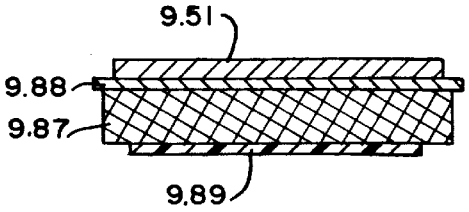
FIG. 46 is a sectional view substantially as taken on line 46—46 of FIG. 44 on a somewhat enlarged scale.

The securing means 9.26 may be of various different physical designs, such as, for example, the magnetic means 44—mounting means 47 assembly as disclosed hereinabove relative to the apparatus 11 and shown in FIGS. 1, 4 and 5, or the cradle-based mounting means 8.47 as disclosed hereinabove and shown in FIGS. 37–40. However, a preferred embodiment of the securing means 9.26 is shown in FIGS. 44–46 and includes a cradle means 9.48 for being securely attached to the portable massaging machine M without requiring any permanent modification of the portable massaging machine M. The cradle means 9.48 preferably includes an upper arm 9.49 for extending over or otherwise gripping the upper edge of the housing 13 of the portable massaging machine M, a pair of spaced-apart handle grips or arms 9.50 for extending into or otherwise gripping the handles 15 of the housing 13 of the portable massaging machine M, and a body member or frame 9.51 for joining the upper arm 9.49 and spaced-apart handle grips or arms 9.50 together. The spaced-apart handle grips or arms 9.50 may have hook-shaped ends (see FIGS. 41 and 43) for securely gripping the handles 15 of the housing 13 of the portable massaging machine M as clearly shown in FIG. 43. The frame member 9.51 may include a first elongated metal plate formed as an integral, one-piece unit with the upper arm 9.49 and extending at right angles thereto, and a second elongated metal plate formed as an integral, one-piece unit with the spaced-apart handle grips or arms 9.50 extending at right angles thereto and fixedly secured by welding or the like to the first elongated metal plate in a cross-like manner as clearly shown in FIG. 41. Various specific types of securing means can be fixedly attached to the frame 9.51 so that the combined portable massaging machine M and mounting means 9.47 can be movably secured relative to a support member. Thus, for example, the magnetic means 44 could be fixedly attached to the frame 9.51 by being bolted or welded thereof, etc., so that the combined portable massaging machine M and mounting means 9.47 could be used with the body member 25 as will now be apparent to those skilled in the art. Alternatively, the combined magnetic means 3.44 and guide means 3.93 or the securing means 4.141 could be fixedly attached to the frame 9.51 by being bolted or welded thereof, etc., so that the combined portable massaging machine M and mounting means 9.47 could be used with the bar 83 of the chair S as will now be apparent to those skilled in the art. On the other hand, a pair of the securing means 7.141 may be fixedly attached to the frame 9.51 by welding or the like, with one securing means 7.141 attached adjacent the top of the frame 9.51 and the other securing means 7.141 attached adjacent the lower end of the frame 9.51 similar to that shown in FIG. 38 with respect to the mounting means 8.47, so that the combined portable massaging machine M and mounting means 9.47 could be used with the bar 83 of the chair S as will now be apparent to those skilled in the art. The securing means may consist simply of a magnet attached to the lower end of the frame 9.51. As shown in FIGS. 41–43, the securing means preferably includes a magnetic means similar to the magnetic means 2.85 shown in FIGS. 10 and 11. Thus, the securing means may include one or more off-the-shelf bar-type ceramic magnets 9.87, a rigid, preferably metal backing plate 9.88 cemented or otherwise fixedly attached to the magnet 9.87 and to the lower end of the frame 9.51 to thereby fixedly joint the magnet 9.87 to the frame 9.51, and a facing plate 9.89 for covering all or portions of the face of the magnet 9.87 to protect and reduce wear, noise, etc., of the face of the magnet 9.87 as will now be apparent to those skilled in the art. The facing plate 9.89 may consist of one or more pieces of a suitable plastic such as nylon, etc. Appropriate cement or the like (not shown) is preferably provided to fixedly secure the magnet 9.87 and the facing plate 9.89 together.

The anchor means 9.24 preferably includes a seat member 9.101 for placement on the seat portion 21 of the chair C, etc., and for being sat upon by the person using the apparatus 9.11 so that the weight of the person using the apparatus 9.11 will securely anchor the seat member 9.101 in place on the seat portion 21 of the chair C, etc. The seat member 9.101 may be constructed in various manners, out of various materials, in various shapes and sizes, etc. Thus, for example, the seat member 9.101 may include a strong, substantially rigid base 9.103 constructed out of a strong, substantially rigid plastic or the like in a size and shape to fit on top of the seat portion 21 of the chair C, etc., and to receive the person using the apparatus 9.11, and may include a relatively soft cushion portion 9.105 positioned on top of the base 9.103.

The apparatus 9.11 preferably includes hinge means 9.107 for hingeably attaching the backboard member 9.25 to the seat member 9.101 of the anchor means 9.24. The hinge means 9.107 may be of any typical construction having, for example, a first portion or leaf 9.109 fixedly attached to the first or lower end 9.30 of the backboard member 9.25, and a second portion or leaf 9.111 fixedly attached to the rear, center of the base 9.103 of the seat member 9.101 of the anchor means 9.24 and pivotally attached to the first portion or leaf 9.109 so that the backboard member 9.25 can be moved between a compact, folded position against the top of the seat member 9.101 and an opened position resting against the back portion 23 of the chair C, etc., as shown in FIG. 41.

The operation and use of the apparatus 9.11 of the present invention is quite simple and basically similar to the operation and use of the apparatus 11 discussed hereinabove. A portable massaging machine M is attached to the securing means 9.26 by, for example, extending the upper arm 9.49 of the cradle means 9.48 over the upper edge of the housing 13 of the portable massaging machine M, while extending the arms 9.50 of the cradle means 9.48 into the handles 15 of the housing 13 of the portable massaging machine M as illustrated in FIG. 45. The seat portion 9.101 of the anchor means 9.24 is merely placed on top of the seat portion 21 of the chair C, etc., and the backboard member 9.25 rested against the back portion 23 of the chair C. The magnet 9.87 can be inserted between the first and second ridge members 9.37, 9.39 of the backboard member 9.25 and against the face surface 9.29 of the magnetic portion 9.27 thereof to slidably secure the portable massaging machine M to the backboard member 9.25 as will now be apparent to those skilled in the art. The user of the apparatus 9.11 can then merely sit on the seat portion 9.101 of the anchor means 9.24 to securely anchor and hold the combined apparatus 9.11 and portable massaging machine M to the chair C or other support member, as will now be apparent to those skilled in the art. The combined portable massaging machine M and securing means 9.26 can be easily moved up and down on the backboard member 9.25 to position the massaging fingers 19 of the portable massaging machine M at any desired location, depending on the height of the user, the specific area of the user's back it is desired to massage, etc., by merely pushing the portable massaging machine M up and/or down on the backboard member 9.25 against the force of the magnet 9.87, etc. If treatment is desired for problems in the thigh and leg areas, the massaging action can be applied to the lower lumbar vertebrae housing the nerves which supply these areas. Similarly, by raising the position of the machine to a higher level, it will massage vertebrae which house nerves supplying abdominal, thoracic or neck areas.

Although the present invention has been described and illustrated with respect to preferred embodiments and preferred uses therefor, it is not to be so limited since modifications and changes can be made therein which are within the full intended scope of the invention.

What is claimed is:

1. An apparatus for mounting a portable massaging machine relative to a support member having a seat portion; said apparatus comprising:

(a) anchor means for being held fixed to the support member by the person using the apparatus said anchor means including a seat member for placement on the seat portion of the support member and for being sat upon by the person using the apparatus;

(b) a backboard member attached to said anchor means; and (c) securing means for movably securing the portable massaging machine to said backboard member; and (d) hinge means for hingeably attaching a back board member to a seat member of said anchoring means.

2. The apparatus of claim 1 in which said seat member of said anchor means includes a cushion portion.

3. An apparatus for mounting a portable massaging machine relative to a support member having a seat portion; said apparatus comprising:

(a) a seat member for placement on the seat portion of the support member and for being sat upon by the person using the apparatus;

(b) an elongated backboard member having a first end attached to said seat member and having a second end; and (c) securing means for movably securing the portable massaging machine to said backboard member; and (d) hinge means for hingeably attaching a said first end of said back board member to said seat member.

4. The apparatus of claim 3 in which is included mounting means for mounting said securing means to the portable massaging machine.

5. The apparatus of claim 4 in which said mounting means includes a cradle means for being securely attached to the portable massaging machine without requiring any permanent modification of the portable massaging machine.

6. The apparatus of claim 5 in which the portable massaging machine includes a housing having spaced-apart sides, a handle on each side thereof, an upper edge, a back surface, and a face surface with massaging fingers extending therefrom; and in which said cradle means includes an upper arm for gripping the upper edge of the housing of the portable massaging machine, a pair of spaced-apart handle grips for gripping the handles of the housing of the portable massaging machine, and a frame for joining the upper arm and spaced-apart handle grips together.

7. The apparatus of claim 6 in which in which said backboard member includes a magnetic portion, and in which said securing means includes a magnet attached to said cradle means for movable attachment to said magnet of said securing means.

* * * * *